US005739450A

United States Patent [19]

Fujiwara et al.

[11] Patent Number: 5,739,450

[45] Date of Patent: Apr. 14, 1998

[54] KEYBOARD MUSICAL INSTRUMENT EQUIPPED WITH DUMMY KEY/HAMMER EVENT SUPPLEMENTING SYSTEM

[75] Inventors: Yuji Fujiwara; Taro Kawabata; Yoshimasa Isozaki; Yasuhiko Oba, all of Shizuoka, Japan

[73] Assignee: Yamaha Corporation, Japan

[21] Appl. No.: 407,771

[22] Filed: Mar. 21, 1995

[30] Foreign Application Priority Data

Mar. 25, 1994 [JP] Japan ..... 6-079604

[51] Int. Cl.[6] ..... G10G 3/04

[52] U.S. Cl. ..... 84/462; 84/20

[58] Field of Search ..... 84/462, 461, 115, 84/151, 20, 25

[56] References Cited

U.S. PATENT DOCUMENTS 4,993,306 2/1991 Ueta et al. ..... 84/462

5,254,804 10/1993 Tamaki et al. ..... 84/462

*Primary Examiner*—Cassandra C. Spyrou

*Attorney, Agent, or Firm*—Graham & James LLP

[57] ABSTRACT

An automatic player piano records an original key motion reciprocated between a rest position and an end position as a series of a key-on event, a hammer event and a key-off event by using key/hammer sensors, and supplements the key/hammer event for an unusual key motion such as a half stroke, thereby faithfully reproducing the original key motions in a playback mode.

6 Claims, 29 Drawing Sheets t10
t11
t12
10.00
0.00
(mm)
2000
2200
2400
2600
2800
3000
3000(ms)
[ms]

10.00
0.00
[mm]
2000
3000 [ms]
1750
1800
1850
1900
1950
2000
[ms]

10.00
0.00
[mm]
2000
3000 [ms]
2200
2400
2600
2800
3000
[ms]

10.00
0.00
[mm]
1750
2000[ms]
1800
1850
1900
1950
2000
[ms]

10.00
0.00
[mm]
2000
3000
[ms]
2200
2400
2600
2800

10.00
[mm]
0.00
1750
2000 [ms]
1800
1850
1900
1950
2000
[ms]

KEYBOARD MUSICAL INSTRUMENT EQUIPPED WITH DUMMY KEY/HAMMER EVENT SUPPLEMENTING SYSTEM

FIELD OF THE INVENTION

This invention relates to a keyboard musical instrument and, more particularly, to a keyboard musical instrument such as, for example, an automatic player piano equipped with a dummy key/hammer event supplementing system.

DESCRIPTION OF THE RELATED ART

A typical example of the automatic player piano is equipped with key sensors or hammer sensors, and the key sensors or the hammer sensors are used for detecting on/off events of the associated keys or on/off events of the associated hammers. While a player is performing a music, the prior art automatic player piano sequentially determines the average key velocity or the average hammer velocity for each of the depressed keys, and generates a series of music data codes so as to record the performance. If the prior art automatic player piano enters into a playback mode after the recording, the automatic player piano sequentially reads out the series of music data codes, and controls depressing/releasing timing and the depressed key velocity for the key represented by each read-out music data code. Thus, the prior art automatic player piano reproduces the performance. If the series of music data codes are immediately supplied to another automatic player piano, the performance is reproduced at a distant place in a real time manner.

As described hereinbefore, the prior art automatic player piano simply controls the depressing/releasing timings and the average key velocity in the playback mode. The average key velocity does not exactly represent the key motion. Namely, even though the player changes the key velocity on the way from the rest position to the end position in a different manner such as slow-to-swift and swift-to-slow, the prior art automatic player piano possibly determines the average key velocity equal to one another; nevertheless, the sounds give different impression to a listener. Thus, the prior art automatic player piano ignores the difference of the key motions, and, for this reason, hardly reproduces the original performance.

The present inventors proposed an automatic player piano in Japanese Patent Application Nos. 5-344241 and 5-344242 filed on Dec. 17, 1993, and a U.S. Patent Application claiming the convention priority right was filed on the basis of these Japanese Patent Applications. The Japanese Patent Applications were not published on the filing date of the Japanese Patent Application on which the present U.S. Patent Application is based. The invention disclosed in the previous U.S. Patent Application is entitled as "AUTOMATIC PLAYER PIANO AND ESTIMATOR FOR ACCELERATION OF DEPRESSED KEY INCORPORATED IN THE AUTOMATIC PLAYER PIANO". The proposed automatic player piano controls a key in such a manner as to pass a reference point with a physical quantity such as an acceleration. The physical quantity at the reference point exactly represents the key motion, and the proposed automatic player piano exactly reproduces the original key motions.

However, the proposed automatic player piano calculates the physical quantity on the basis of a detected hammer velocity, by way of example, and takes a detected impact time and the hammer velocity into account for determining the key motion in the playback mode. For this reason, if the sensor misses the detection of the original motion, the automatic player piano can not determine the expected physical quantity in the key motion, and hardly controls the key in the playback mode.

SUMMARY OF THE INVENTION

It is therefore an important object of the present invention to provide a keyboard musical instrument which exactly reproduces key motions in spite of missing information.

It is also an important object of the present invention to provide a data repairing system which exactly produces a music data code in spite of missing information.

To accomplish the object, the present invention proposes to supplement dummy event data.

In accordance with one aspect of the present invention, there is provided a keyboard musical instrument comprising: an event detecting means for detecting a key depressing event and a strike event; a memory means for storing the key depressing event and the strike event; an event repairing means operative to read out contents of the memory means and supplement missing event if the key depressing event or the strike event is missed, thereby producing a music data; and a key driving means operative to determine a target trajectory for a key, and driving the key along the target trajectory.

In accordance with another aspect of the present invention, there is provided a dummy event supplementing system comprising: a deciding means operative to decide whether or not there is a piece of missing event data information in pieces of event data information when a music data code containing the pieces of event data information is supplied thereto; and an event repairing means operative to supplement the piece of missing event data information to the music data code when the deciding means determines that there is the piece of missing event data information.

In accordance with yet another aspect of the present invention, there is provided a data processing system comprising: an event data processing means supplied with a music data including a plurality of event sub-data respectively having pieces of time information, and operative to carry out a data processing on the plurality of event sub-data and, thereafter, output a plurality of processed event sub-data; and a delay means operative to delay the plurality of processed event sub-data for regulating a total of the delay and a time period consumed by the event data processing means to a certain value.

In accordance with still another aspect of the present invention, there is provided a data processing system comprising: a delay means supplied with a music data including a plurality of event sub-data, and operative to introduce a time delay into a propagation of each of the plurality of event sub-data, and a delay time regulating means operative to regulate the time delay to a certain value on the basis of an execution timing of an event represented by the aforesaid each of the plurality of event sub-data.

BRIEF DESCRIPTION OF THE DRAWINGS

The features and advantages of the keyboard musical instrument according to the present invention will be more clearly understood from the following description taken in conjunction with the accompanying drawings in which.

DESCRIPTION OF THE PREFERRED EMBODIMENTS

First Embodiment

1: Control Principle

Figure 1:
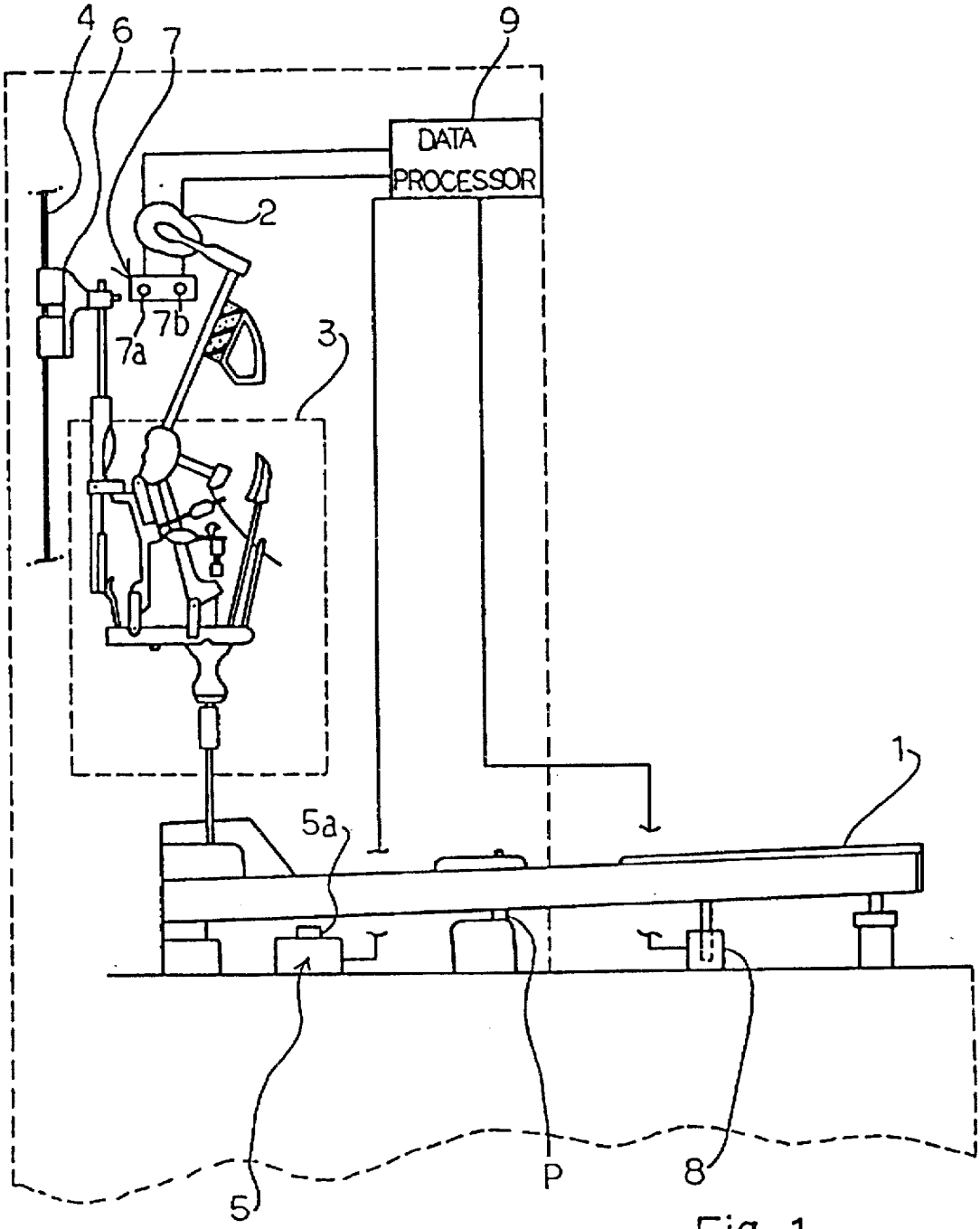
FIG. 1 is a side view showing an automatic player piano.

Description is firstly made on a controlling principle for an automatic player piano according to the present invention. FIG. 1 illustrates an automatic player piano comprising a key 1, a hammer 2, a key action mechanism 3 functionally connected to the key 1 for driving the hammer 2, a set of strings 4 struck by the hammer 2, a solenoid-operated actuator 5 for rotating the key 1 instead of the player, a damper 6 for absorbing vibrations of the strings 4, a hammer sensor 7 for monitoring the hammer motion, a key sensor 8 for monitoring the key motion and a data processor 9 connected to the hammer sensor 7, the key sensor 8 and the solenoid-operated actuator 5.

When the solenoid-operated actuator 5 is energized, the plunger 5*a* upwardly projects from a coil (not shown), and rotates the key 1 from a rest position to an end position around a balance key pin P. The key 1 actuates the key action mechanism 3 and the damper 6. The damper 6 actuated by the key action mechanism 3 leaves the set of strings 4, and the key action mechanism 3 drives the hammer 2 for rotation. The hammer 2 rebounds on the set of strings 4, and the damper 4 allows the set of strings to vibrate. When a key is stationary without a downward force, the key is staying in the rest position. On the other hand, when the depressed key terminates the downward motion from the rest position, the key reaches the end position.

The key action mechanism 3, the hammer 2 and the damper 6 similarly behave in an original performance by a player, and the hammer sensor 7 and the key sensor 8 report a current hammer position and a current key position to the data processor 9.

The hammer sensor 7 is implemented by a pair of detectors 7*a* and 7*b* spaced along the trajectory of the hammer 2, and the detectors 7*a* and 7*b* determine respective timings when the hammer 2 passes in front thereof. The data processor 9 counts a time interval between the two timings, and the hammer velocity VH is calculated on the basis of the time interval. The timing at the detector 7*a* is memorized as an impact time ti when the hammer 2 strikes the set of strings 4, and, for this reason, the detector 7*a* is aligned with the rebounding point of the hammer 2.

The data processor similarly determines the trajectory of key 1 on the basis of detected timings reported by the key sensor 8.

In an original performance, the player depresses the key 1 at a constant speed, or changes the key velocity on the way from the rest position to the end position. The different key motions result in difference of hammer impact, and the sounds produced through the different hammer impacts give different impression to a listener. Therefore, it is important to analyze a relation between the variation of the key velocity and the final hammer velocity VH proportional to the hammer impact.

In the following description, word "forward" means a direction from the rest position to the end position, and word "backward" means the opposite direction from the end position toward the rest position.

1-1: Reference Point

Using the automatic player piano shown in FIG. 1, the present inventors measured the key velocity and the final hammer velocity VH, and noticed that the final hammer velocity VH was explainable with a key velocity at a special point on the trajectory of the depressed key. Although the special point was variable not only among the piano models but also the individual products of the same model, the special points ranged between 9.0 millimeters and 9.5 millimeters under the rest positions. Then, the present inventor concluded that the hammer impact was exactly reproducible by controlling the key velocity at the special point.

The special point is hereinbelow referred to "reference point Xr", and the key velocity at the reference point Xr is called as "reference velocity Vr".

1-2: Reference Velocity

Figure 2:
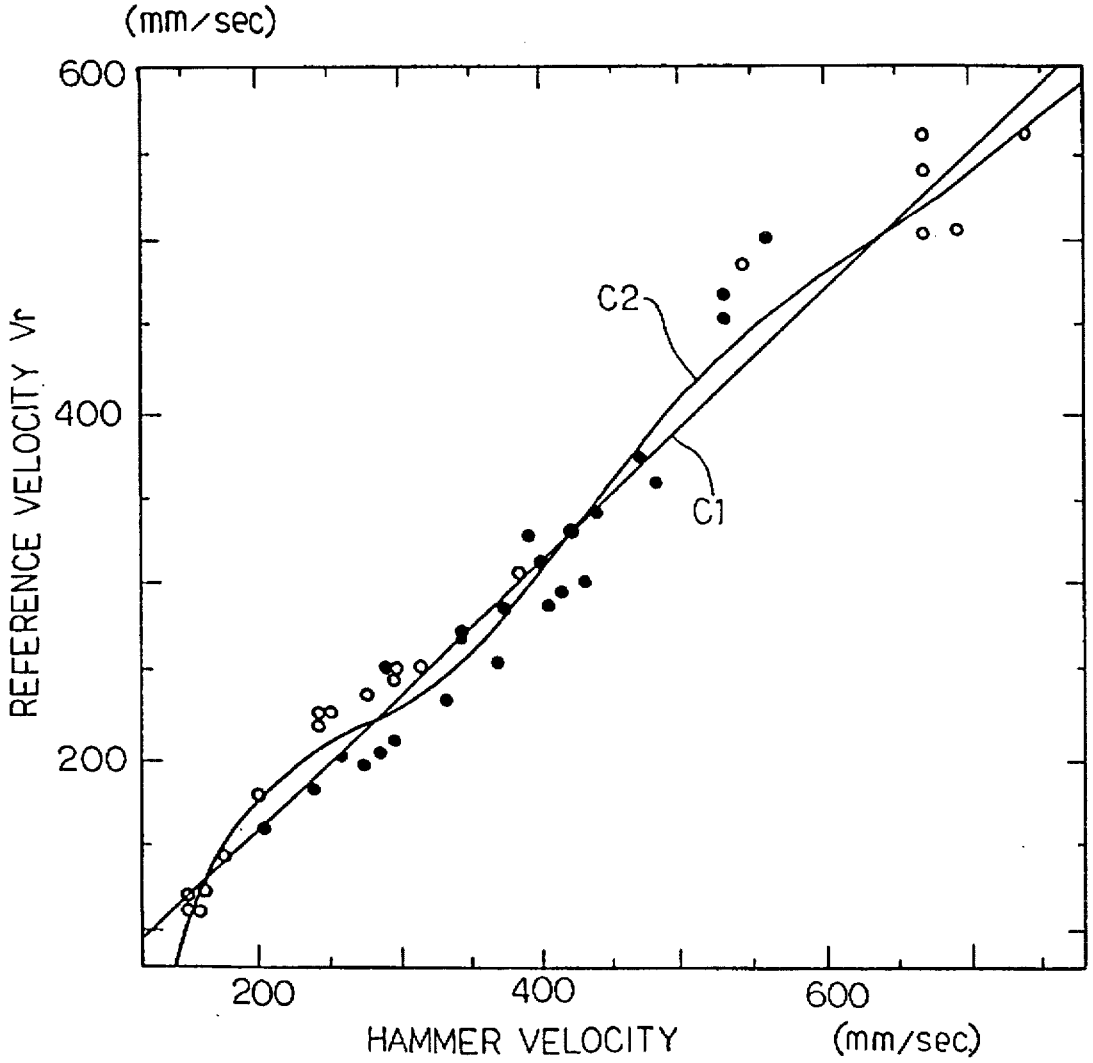
FIG. 2 is a graph showing a reference velocity in terms of a final hammer velocity.

The present inventors plotted the hammer velocity VH in terms of the reference velocity Vr in FIG. 2. The reference point Xr was set to 9.5 millimeters below the rest position. Bubbles stand for the hammer velocities measured in single key downward motions each depressed from the rest position to the end position, and dots represent the hammer velocities measured in repetition where the key 1 returns toward the rest position before reaching the end position. C1 is indicative of the first-order least square approximation, and C2 is the sixth-order least square approximation.

As will be understood, the relation between the reference velocity Vr and the final hammer velocity VH is well approximated by using the linear line C1 and the non-linear line C2. Inversely, the reference velocity Vr of a key 1 can be determined by using an impact data indicative of the final hammer velocity VH. The present inventors employ the linear line C1 indicative of the first-order least square approximation, and the reference velocity Vr is calculated as follows.

$$Vr=alpha\times VH+beta \qquad \text{Equation 1}$$

where alpha and beta are constants. The constants alpha and beta are determined through experiments using an actual automatic player piano. The constants alpha and beta are variable by changing the reference point Xr.

1-3: Reference Time Interval

Subsequently, it is necessary for the exactly reproduced key motion to determine a reference time tr when the key 1 passes the reference point Xr. Now, let us define a reference time interval Tr as "a time interval between the reference time tr and an impact time ti when the hammer 2 strikes the strings 4". The detector 7*a* is aligned with the rebounding point, and the timing data reported by the detector 7*a* is indicative of the impact time ti.

Figure 3:
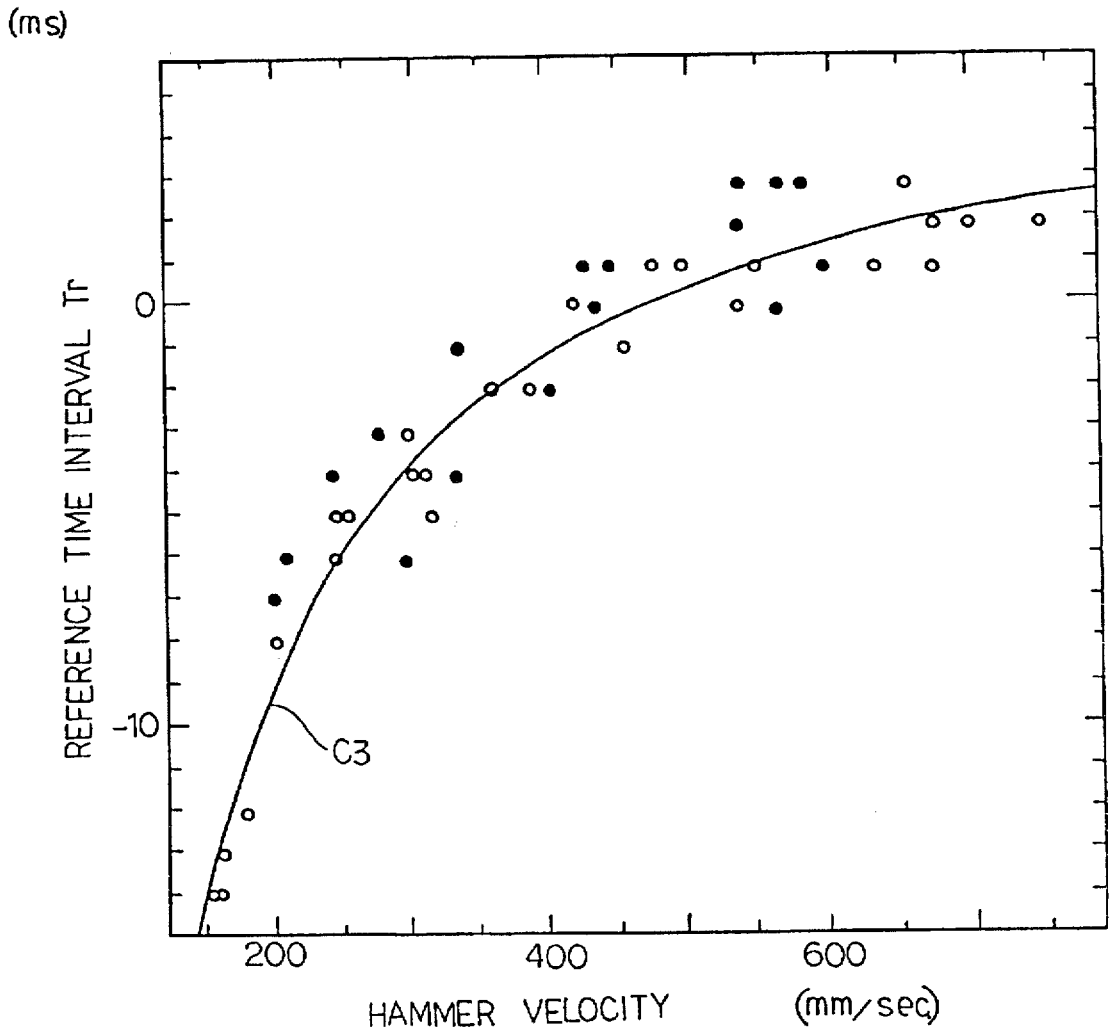
FIG. 3 is a graph showing a reference time interval in terms of the final hammer velocity.
Figure 4:
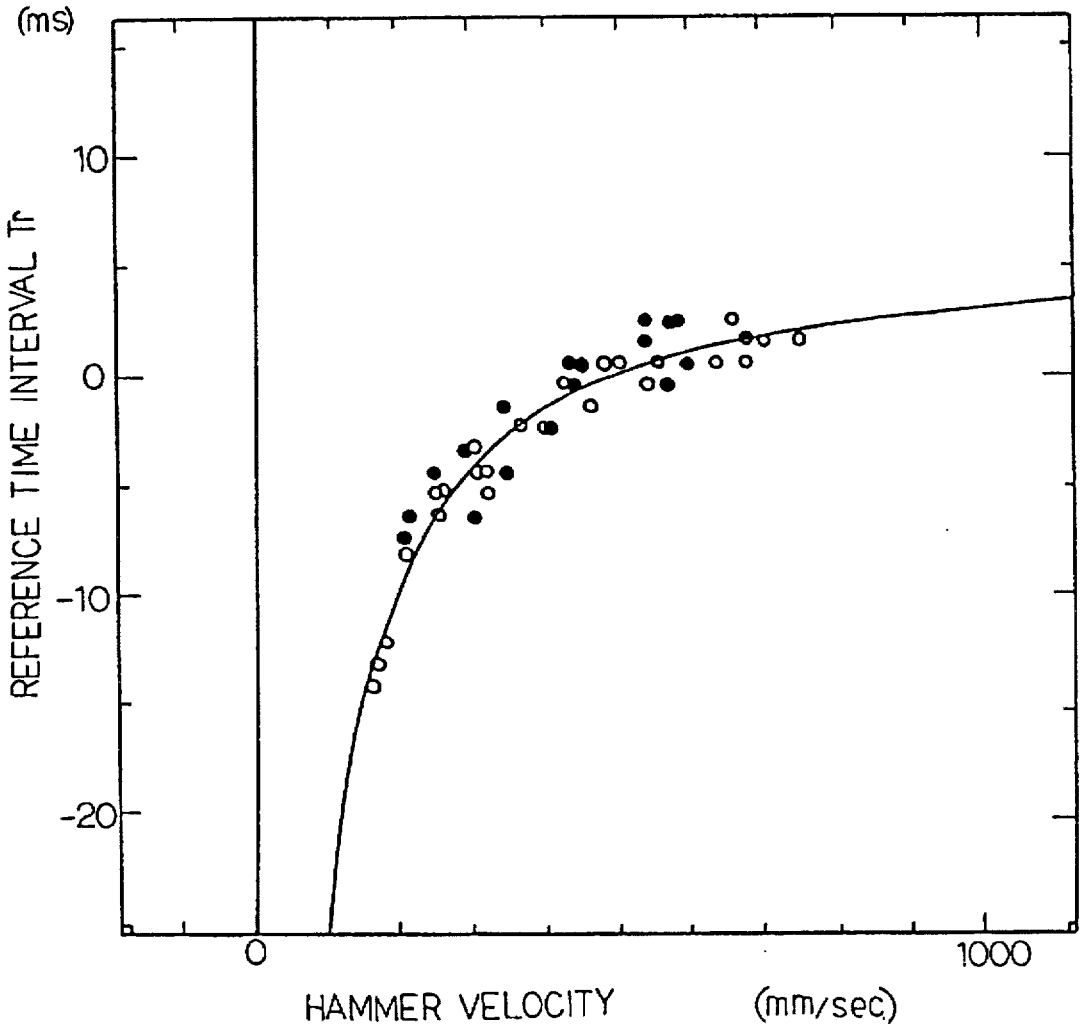
FIG. 4 is a graph showing the relation between the reference time interval and the final hammer velocity scaled up at 200 per cent.
Figure 5:
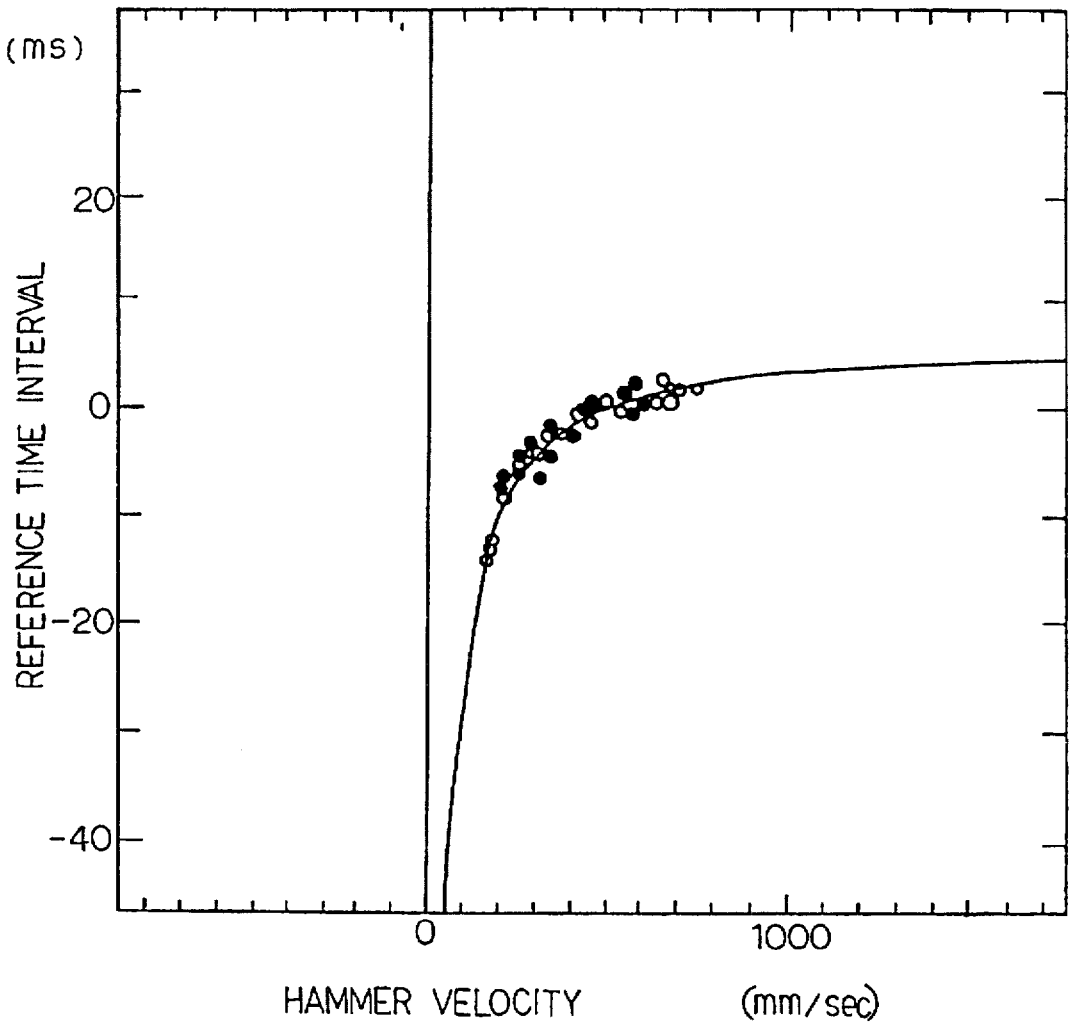
FIG. 5 is a graph showing the relation between the reference time interval and the final hammer velocity scaled up at 400 per cent.

The present inventors plotted the reference time interval Tr in terms of the final hammer velocity VH in FIG. 3. Bubbles stands for the reference time intervals in the single downward key motions, and dots represents the reference time intervals in the repetition as similar to FIG. 2. The relation between the reference time interval Tr and the final hammer velocity VH is scaled up at 200 percent in FIG. 4, and at 400 percent in FIG. 5. The reference time intervals Tr are approximated by a hyperbolic line C3, and is expressed as Equation 2.

$$Tr=1\ (c/VH)+d \qquad \text{Equation 2}$$

where c and d are constants, and are determined through experiments. When the reference point Xr is changed in the experiments, constants c and d are varied depending upon the reference point Xr.

If the reference time interval Tr is calculated by using Equation 2, the reference time tr is given by subtracting the reference time interval Tr from the difference between a lapse of time between a key-on time t0 of the key motion and the impact time ti. An original hammer impact is faithfully reproduced for an original sound if the key 1 is controlled in such a manner as to pass the reference point Xr at the reference time tr at the reference velocity Vr.

If the hammer 2 is arranged in such a manner as to strike the strings 4 at the reference point Xr, the reference time interval Tr is useless.

1-4: Control without Missing Data

Thus, the key 1 passing at the reference point Xr with the reference velocity Vr results in a faithful reproduction of the original sound. The present inventors form a feedback loop, and controls the key 1 through the feedback loop in accordance with a table indicating a relation between a target key position and a lapse of time from a key-on time t0. The table may be produced on the assumption that the key 1 behaves as a uniform motion, a uniformly accelerated motion or another position predictable motion. Of course, it is important to approximate the key motion to an easily controllable motion. If the approximated motion requires an acceleration, the acceleration at the reference point is calculated on the basis of the reference key velocity Vr.

1-5: Supplement of Dummy Event

While the automatic player piano is producing a series of music data code signals indicative of an original performance, the data processor 9 requires the hammer sensors 7 and the key sensors 8 to exactly report the key position and the hammer position. However, it is unavoidable to miss a detection, and the data processor 9 only obtains incomplete data.

Figure 6:
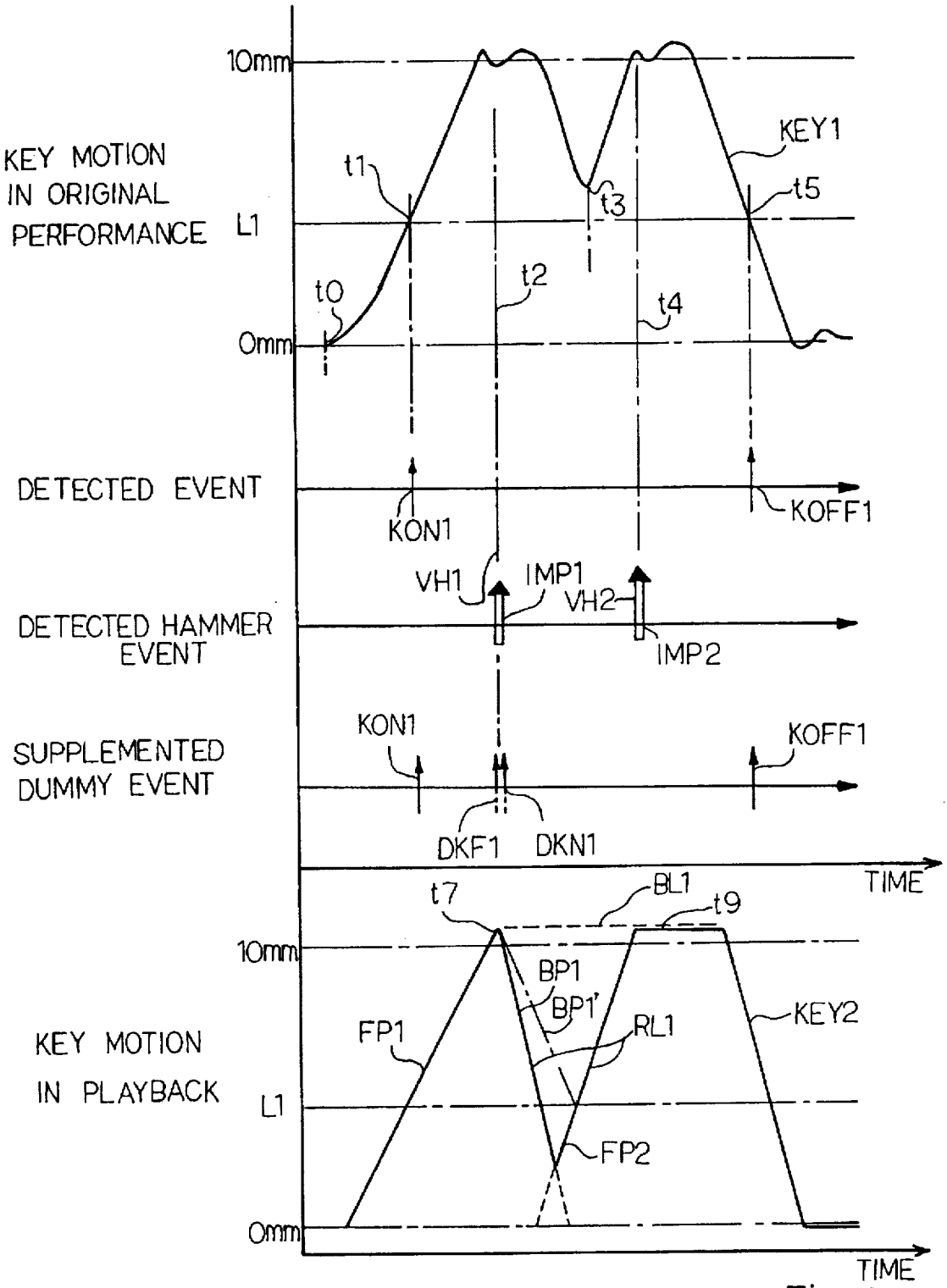
FIG. 6 is a time chart showing an original key motion, detected key/detected hammer events, supplemented dummy key events and a reproduced key motion.
Figure 7:
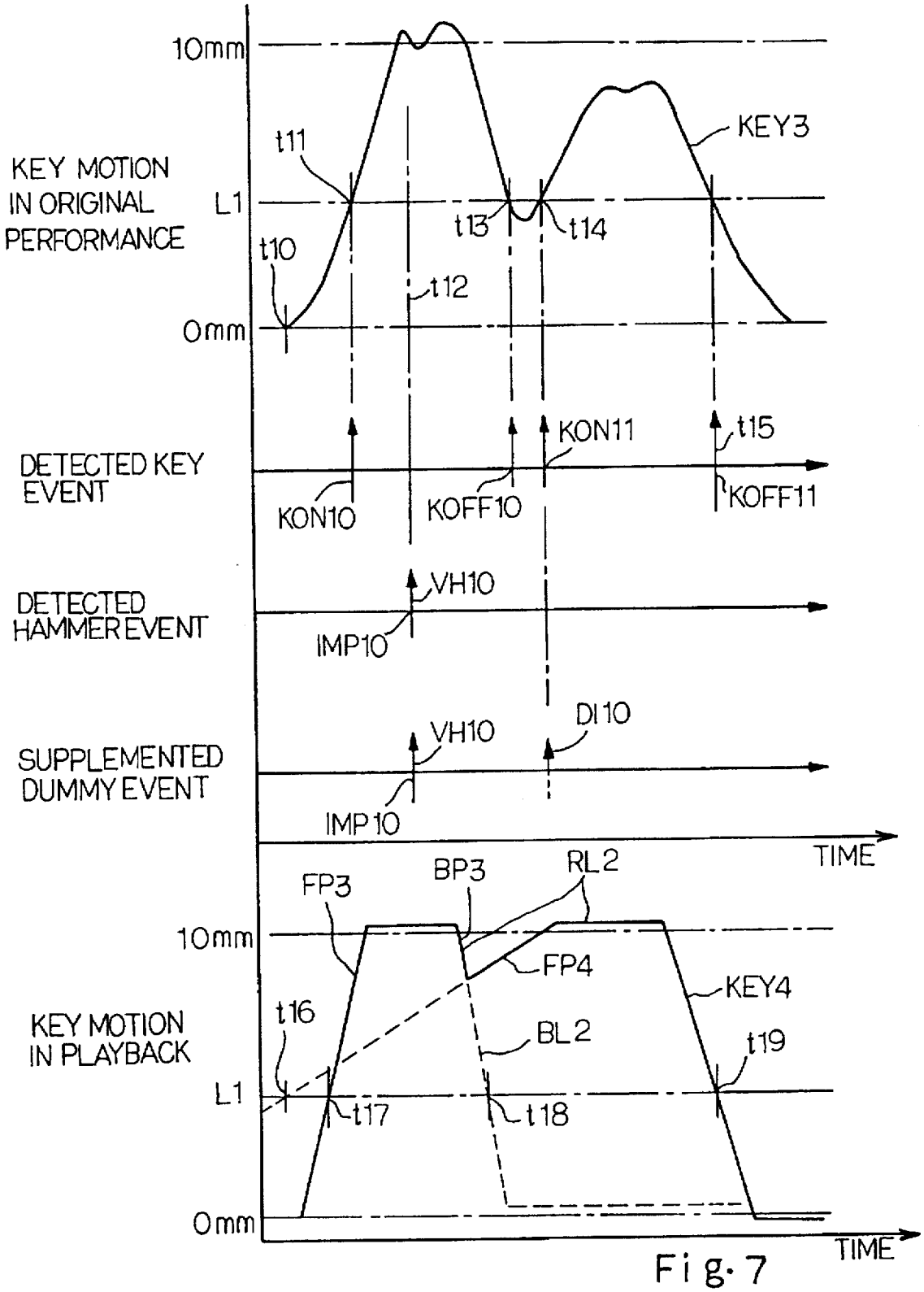
FIG. 7 is a time chart showing another original key motion, the detected key/detected hammer events, supplemented dummy hammer events and a reproduced key motion.

FIGS. 6 and 7 illustrate supplements of dummy events according to the present invention. When a player depresses the key 1, the key 1 sinks from zero to 10 millimeters, and the key position is plotted on a line labeled with "KEY1". When the key passes a detecting point L1, the key sensor 8 detects the key 1, and the data processor 9 acknowledges a key-on event representative of a key depressing action or a key-off event representative of a key releasing action. On the other hand, when the hammer 2 reaches the rebounding point, the detector 7*a* detects the hammer shank, and the data processor 9 acknowledges a hammer event representative of an impact at the strings 4.

The key 1 makes to downwardly move at time t0, and passes the detecting point L1 at time t1. Therefore, the data processor 9 acknowledges the key-on event KON1 at time t1. The key 1 makes to return toward the rest position about time t2. Then, the data processor 9 determines the hammer event IMP1 at time t2, and calculates the final hammer velocity VH1. The key 1 changes the direction on the way toward the rest position at time t3; nevertheless, the data processor 9 does not acknowledge the key-off event, because the key 1 does not pass the detecting point L1. The key 1 proceeds toward the rest position at time t4 again, and makes to return toward the rest position at time t4. The detector 7*a* notices the hammer shank, and the data processor determines another hammer event IMP2 and the final hammer velocity VH2. The key 1 passes the detecting point L1 at time t5, and reaches the rest position. When the key passes the detecting point L1, the data processor 9 acknowledges the key-off event KOFF1.

Although a hammer event has to take place between a key-on event and a key-off event, i.e., between a forward key motion and a backward key motion, the key 1 shown in FIG. 6 has the two hammer events IMP1 and IMP2 between the key-on event KON1 and the key-off event KOFF1, and a key-on event and a key-off event are missed between the key-on event KON1 and the key-off event KOFF1. The data processor 9 can not treat the irregular key motion without the missing key-events. For this reason, the data processor 9 supplements a dummy key-off event DKF1 and a dummy key-on event DKN1 around time t2 between the key-on event KON1 and the key-off event KOFF1. As a result, the hammer events IMP1 and IMP2 respectively take place between the key-on event KON1 and the dummy key-off event DKF1 and between the dummy key-on event DKN1 and the key-off event KOFF1, and the data processor 9 produces the music data code signals on the basis of the key motion. While the automatic player piano is reproducing the music, the data processor 9 reproduces the original key motion KEY1 as indicated by Plots KEY2 in the playback mode.

The data processor 9 is further expected to supplement the dummy hammer events for the hammer action. FIG. 7 illustrates the supplement of dummy hammer events in a half stroke, and the key 1 is assumed to trace Plots KEY3.

The key 1 makes to downwardly move at time t10, and passes the detecting point L1 at time t11. Therefore, the data processor 9 acknowledges the key-on event KON10 at time t11. The key 1 makes to return toward the rest position about time t12, and the hammer sensor 7 detects the hammer shank. The data processor 9 acknowledges the hammer event IMP10, and determines the final hammer velocity VH10. On the way toward the rest position, the key 1 passes the detecting point L1, and the key sensor 8 detects the key 1 passing the detecting point L1, and the data processor 9 acknowledges the key-off event KOFF10.

After passing the detecting point L1, the key 1 returns and proceeds toward the end position again. The key 1 passes the detecting point L1 again at time t14, and the key sensor 8 causes the data processor 9 to discriminate the key-on event KON11.

Since the half stroke aims at an actuation of the damper 6, the depressing force is so weak that the key 1 makes to return toward the rest position without an impact at the strings 4. For this reason, the hammer sensor 7 does not detect the hammer shank, and, accordingly, the data processor 9 does not determine a hammer event. The key 1 changes the direction of its motion, and the key 1 passes the detecting point L1 at time t15. Then, the key sensor 8 detects the key 1, and the data processor 9 acknowledges the key-off event KOFF11.

The key-off event KOFF11 follows the key-on event KON11 without a hammer event, and, for this reason, the data processor 9 supplements a dummy weak hammer event DI10 around time t14. The dummy weak hammer event DI10 is representative of an extremely slow hammer velocity without an impact. The Thus, the set of three events, i.e., a key-on event, a hammer event and a key-off event are coded into the music data code signal, and the data processor 9 reproduces the key motion as indicated by Plots KEY4 in the playback mode.

Although the dummy key/dummy hammer events are supplemented to the music data code signal at the same time as the detected key/detected hammer events in FIGS. 6 and 7, the times for the dummy events are appropriately modified for generating the trajectorys for the key 1, and the modification is described hereinlater in detail. The reason why the dummy key/dummy hammer event is supplemented is that the data processor 9 hardly determine the trajectorys KEY2 and KEY4 without the key-on/key-off events and the hammer event. In fact, if the dummy key-off event DKF1 and the dummy key-on event DKN1 are not supplemented, the key 1 traces broken line BL1 instead of real line RL1 in FIG. 6. The key 1 also traces broken line BL2 instead of real line RL2 without the supplement of the dummy weak hammer event DI10 in FIG. 7.

1-6: Outline of Data Processing

As described hereinbefore, when the reference velocity Vr at the reference point Xr is determined, the automatic player piano can reproduce the impact at the strings 4 in the playback mode. Even if either key or hammer event is missed, the dummy hammer/key event is supplemented, and any kind of key motion such as the half stroke is stably reproduced in the playback mode.

In order to determine a forward trajectory for the key 1, the data processor 9 determines the target key position for the key 1 in terms of the lapse of time from the key-on time t0, and regulates the key velocity at the reference point Xr to the reference velocity Vt. This control is achieved by a feedback control so as to match the actual key position to the corresponding target key position. The forward trajectory of the key 1 may be approximated as a linear line for a uniform key motion or a parabola for a uniformly accelerated key motion. Of course, the key motion is approximated to any kind of line exactly reproducible in the playback mode.

2: Structure of the Automatic Player Piano

FIG. 1 illustrates the outline of an automatic player piano embodying the present invention, and largely comprises an acoustic piano 10 and an automatic playing system 11. The acoustic piano 10 comprises a keyboard having a plurality of keys 10*a*, a plurality of key action mechanisms 10*b* functionally connected to the keys 10*a*, respectively, a plurality of hammer assemblies 10*c* driven for rotation by the associated key action mechanisms 10*b*, a plurality of damper mechanisms 10*d* also actuated by the associated key action mechanisms 10*b* and a plurality of sets of strings 10*e* struck by the associated hammer assemblies 10*c*. The acoustic piano is basically similar to a standard upright piano, and no further description is incorporated hereinbelow for the sake of simplicity. In this instance, although the standard upright piano is used for the acoustic piano, a grand piano is available for the acoustic piano.

The automatic playing system 11 comprises a plurality of key sensors 11*a* for monitoring the keys 10*a*, a plurality of hammer sensors 11*b* for monitoring the hammer assemblies 10*c*, a plurality of solenoid-operated actuator units 11*c* for actuating the associated keys 10*a* and a controlling unit 11*d*. Each of the key sensors 11*a* detects an actual key position of the associated key 1 moved between the rest position and the end position, and supplies a key position signal KP indicative of the actual key position of the associated key 10*a* to the controlling unit 11*d*. Each of the hammer sensors 11*b* also detects an actual hammer position, and supplies a hammer position signal HP to the controlling unit 11*d*.

The controlling unit 11*d* has a playback section 11*g* and a recording section 11*h*, and the playback section 11*g* and the recording section 11*h* are selectively enabled in a playback mode and a recording mode.

The playback section 11*g* comprises a preliminary treatment unit 11*i*, a motion controlling unit 11*j* and a servo-controlling unit 11*k*. A series of music data code signals are sequentially supplied from a real time communication system (not shown) or an external memory system (not shown) such as, for example, a floppy disk controller to the preliminary treatment unit 11*i*, and determines forward/backward trajectorys for the keys 10*a* identified by the music data code signals. Namely, the preliminary treatment unit 11*i* calculates the reference velocity Vr and the reference time tr for each key 10*a*, and determines the forward/backward trajectory for the key 10*a*. If an approximated trajectory such as a parabolic trajectory requires an acceleration, the preliminary treatment unit 11*i* calculates the acceleration. The preliminary treatment unit 11*i* a plurality of preliminary control data signals PCTL1 to the motion controlling unit 11*j*, and the preliminary control data signals PCTL1 are representative of the forward/backward trajectorys of the keys 10*a* to be actuated by the solenoid-operated actuator units 11*c*.

The motion controlling unit 11*j* is responsive to the preliminary control data signals PCTL1 so as to generate a plurality of control data signals CTL1 each indicative of an expected plunger motion of a plunger 11*m* of the solenoid-operated actuator unit 11*c*. A series of expected plunger positions of the plunger 11*m* form the expected plunger motion, and the associated key 10*a* is moved along the target key positions by the plunger 11*m* in the playback mode.

The motion controlling unit 11*j* supplies the control data signals CTL1 to the servo-controlling unit 11*k*, and the servo-controlling unit 11*k* supplies driving currents DR corresponding to the values of the control data signals DTL1 to the solenoid-operated actuator units 11*c*. Each of the solenoid-operated actuator units 11*c* has a built-in position sensor 11*n* for monitoring an actual plunger position of the plunger 11*m*, and the build-in position sensor 11*n* supplies a feedback signal FB indicative of the actual plunger position to the servo-controlling unit 11*k*. The servo-controlling unit 11*k* controls the amount of the driving current such that the actual plunger position is matched with the expected plunger position.

Thus, the plungers 11*m* are controlled such that the associated keys 10*a* passes the reference points Xr at the reference velocities Vr, and the hammer assemblies 10*c* strikes the associated sets of strings 10*e* at the same intensities as those in the original performance. For this reason, the original performance is faithfully reproduced in the playback mode.

Each of the key sensors 11*a* is implemented by a shutter plate 11*o* and at least two photo-interrupters 11*p* provided along a trajectory of the shutter plate 11*o*. The shutter plate 11*o* is attached to the bottom surface of the associated key 10*a*, and sequentially interrupts optical paths of the photo-interrupters 11*p* during the key motion between the rest position and the end position. Therefore, the bit pattern of the key position signal KP is changed depending upon the actual key position, and the recording section 11*h* calculates a key velocity on the basis of the key position signal KP. In this instance, a released key velocity VkN is calculated on the basis of a time interval from photo-detecting state of the lower photo-interrupter to the photo-detecting state of the upper photo-interrupter. When the upper photo-interrupter is changed from interrupted state to the photo-detecting state, the recording section 11*h* determines a key recovery time tkN. One of the photo-interrupters of the key sensor 11*a* is aligned with the position L1 (see FIGS. 6 and 7), and the key-on event and the key-off event are detectable by means of the key sensors 11*a*.

The hammer sensor 11*b* is implemented by at least two photo-interrupters 11*q* and 11*r* spaced from each other, and the photo-interrupter 11*r* is aligned with an impact position where the hammer shank 10*f* of the associated hammer assembly 10*c* makes to return due to a rebound of the hammer head 10*g* on the associated set of strings 10*e*. For this reason, the hammer event is detectable by means of the photo-interrupter 11*r* of each hammer sensor 11*b*. The controlling unit 11*d* calculates the hammer velocity VH on the basis of a time interval between interrupted state of the photo-interrupter 11*e* and interrupted state of the photo-interrupter 11*f*.

The recording section 11*h* comprises a recording unit 11*s* and a post treatment unit 11*t*. The key position signals KP and the hammer position signals HP are supplied from the key/hammer sensors 11*a*/11*b* associated with a depressed key 10*a* to the recording unit 11*s*, and the recording unit 11*s* determines the impact time ti, the hammer velocity VH, the released key velocity VkN, the key recovery time tkN for the associated key 10*a*, the key-on event, the key-off event and the hammer event. The recording unit 11*s* supplies preliminary music data signals MS indicative of the impact time ti, the hammer velocity VH, the released key velocity VkN, the key recovery time tkN, the key-on event, the key-off event and the hammer event to the post treatment unit 11*t*, and the post treatment unit 11*t* normalizes the preliminary music data signals indicative of the impact time ti, the hammer velocity VH, the released key velocity VkN and the key recovery time tkN.

The normalization is carried out so as to take up an individuality between products. Namely, each of the automatic player piano has unavoidable differences in the hammer velocity VH, the impact time ti, the released key velocity VkN and the key recovery time tkN due to structural differences of the acoustic piano 10, positional differences of the sensors 11*a* and 11*b* and so forth. In order to share the musical data code signals between different automatic player pianos, the calculated hammer velocity VH, the detected impact time ti, the calculated released key velocity VkN and the detected key recovery time tkN should be modified as if an ideal automatic player piano produces those pieces of information. For this reason, the post treatment unit 11*t* is provided for the preliminary music data signals MS, and the music data code signals are available for another automatic player piano different from the automatic player piano used for the recording.

Another important function of the post treatment unit 11*t* is the supplement of the dummy key/dummy hammer events. If preliminary music data signal is indicative of the hammer events successively taking place, the post treatment unit 11*t* supplements a dummy key-off event and a dummy key-on event between the two hammer events. Similarly, if the preliminary music data signal is indicative of the half stroke, the post treatment unit 11*t* supplements a dummy weak hammer event.

The post treatment unit 11*t* codes the normalized music data signals and the dummy key/dummy hammer events, if any, into the music data code signal, and supplies the music data code signal to the memory system (not shown) or another electronic musical instrument.

3: Function of the Automatic Playing System 3-1: Recording Function

When the automatic playing system 11 enters into the recording mode, the recording section 11*h* sequentially produces the music data code signals during an original performance on the keyboard. A depressed key 10*a* pushes up the associated key action mechanism 10*b*, and the key action mechanism 10*b* actuates the associated damper mechanism 10*d* and the hammer assemblies 10*c*. The damper mechanism 10*d* leaves the contact position, and allows the strings 10*e* to vibrate. On the other hand, the hammer assembly 10*c* is driven for rotation, and strikes the strings so as to allow the strings 10*e* to vibrate. These motions sequentially take place in the original performance upon depressing the keys 10*b*, and the automatic player piano generates acoustic sounds through the vibrations of the strings.

While the player is performing the music, the motions of depressed keys 10*a* are monitored by the associated key sensors 11*a*, and the hammer sensors 11*b* detect the rotations of the associated hammer assemblies 10*c*. As described hereinbefore, the key sensors 11*a* generate the key position signals KP, and the hammer sensors 11*b* produce the hammer position signals HP. The key position signals KP and the hammer position signals HP are supplied to the recording unit 11*s*. Time slots may be assigned to the key sensors 11*a* and the hammer sensors 11*b* so as to determine the sources of the key/hammer position signals KP and HP. The key position signals KP and the hammer position signals HP are transferred to an internal memory (not shown) of the recording unit 11*s*, and a series of actual key positions represented by the key position signal KP and a series of actual hammer positions represented by the hammer position signal HP are temporally stored in the internal as a set of key position data and a set of hammer position data. The recording unit 11*s* calculates the hammer velocity VH and the released key velocity VkN on the basis of the set of key position data and the set of hammer position data for each depressed key 10*a* and the associated hammer assembly 10*c*. In this instance, the key-on time t0 and the key recovery time tkN respectively form a part of the key-on event and a part of the key-off event, and the hammer event is represented by the impact time ti and the hammer velocity VH.

Figure 9A:
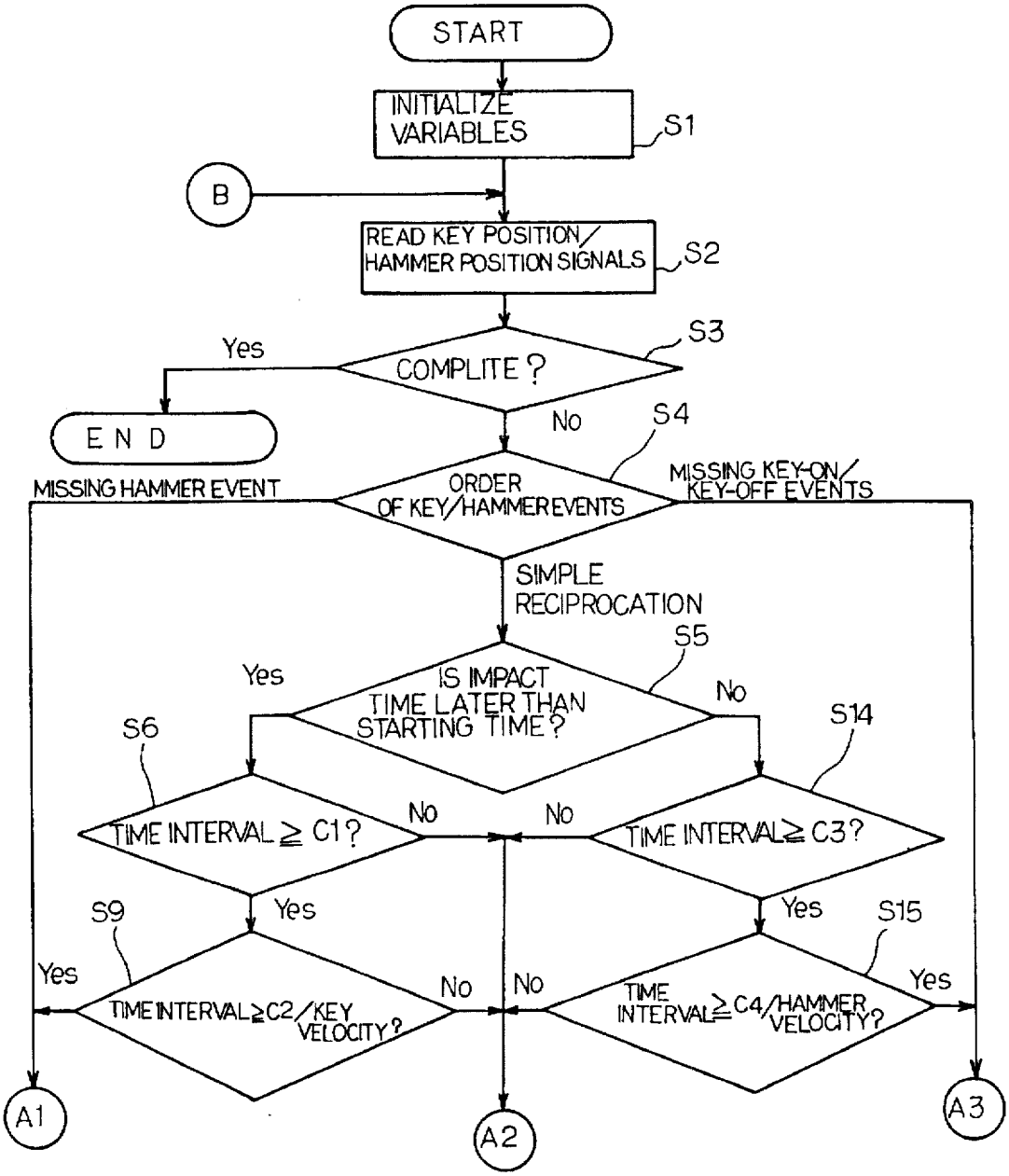
FIGS. 9A and 9B are flow charts showing a program sequence executed by a recording unit incorporated in the automatic player piano.
Figure 9B:
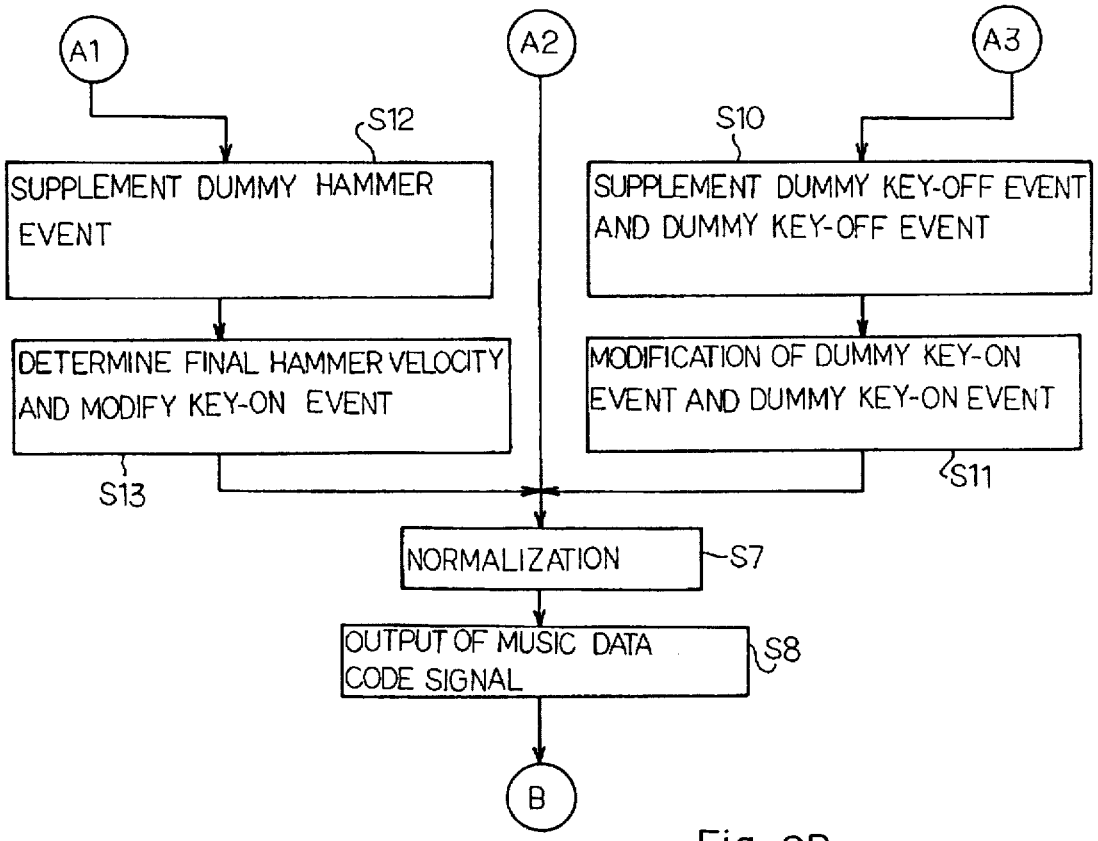

The post treatment unit 11*t* executes a program sequence shown in FIGS. 9A and 9B for producing the music data code signals. Firstly, the post treatment unit 11*t* initializes variables used in the following steps as by step S1. After the loading step S1, the post treatment unit 11*t* scans the internal memory of the recording unit 11*s* to read out the key/hammer events as by step S2. For example, if the read-out data is representative of the key-on event of a certain key 10*a*, the key-off event and the hammer event are also read out from the internal memory of the recording unit 11*s* for the certain key 10*a*, if any.

3-1-1: Data Processing for Usual Fingering

The post treatment unit 11*t* proceeds through step S3 to step S4, and checks the read-out events to see whether or not the player simply reciprocates the key 10*a* through a usual fingering. If the player simply reciprocates the key 10*a*, the hammer event takes place between the key-on event and the key-off event. If the key/hammer events are arranged in this order, the post treatment unit 11*s* proceeds to step S5 to determine whether or not the impact time ti is later than the key-on time t0.

In the simple reciprocating motion, the impact time ti is later than a key-on time t1, and the answer at step S5 is given affirmative. Then, the post treatment unit 11*t* proceeds to step S6, and determines whether or not the time interval between the key-on time t1 and the impact time ti is shorter than a predetermined value C1. The predetermined value C1 is usually longer than a standard time interval between the key-on time t1 and the impact time ti, and is 10 milliseconds in this instance. The simple reciprocation does not consume the standard time interval, and the answer at step S6 is given negative.

The post treatment unit 11*t* proceeds to step S7, and normalize the data related to the certain key 10*a*. After the normalization, the post treatment unit 11*t* proceeds to step S8, and the post treatment unit 11*t* produces the music data code signal so as to output it to the external memory system (not shown).

Upon completion of step S8, the post treatment unit 11*t* returns to step S2, and reiterates the loop consisting of steps S2 to S8 in so far as the player simply reciprocates the keys 10*a*.

3-1-2: Data Processing for Slow Key Motion

While the player is performing the music, a key 10*a* may be softly depressed, and the key 10*a* slowly sinks toward the end position, and slowly returns to the rest position. In this key motion, the time interval becomes longer than the value C1, and the answer at step S6 is given affirmative. Then, the post treatment unit 11*t* proceeds to step S9, and decides whether or not the time interval is longer than a quotient calculated through a division of a constant value C2 by a key velocity. Even if the time interval is longer than the value C1, the key motion may be only slow, and the time interval is reasonable in view of the key velocity. The post treatment unit 11*t* decides whether or not the long time interval is reasonable as by step S9. In this instance, the constant value C2 is 10 millimeter, and the dimension of the constant value C2 is determined as (time)×(length)/(time)=(length).

3-1-3: Data Processing for Key Motion without Key-on/Key-off Event

As already described with reference to FIG. 6, the key sensor 11*a* misses the key-on event and the key-off event in the repetition. In this situation, the post treatment unit 11*t* notices the missing key-on event and the missing key-off event at step S4, and proceeds to step S10. The post treatment unit 11*t* supplements the dummy key-off event and the dummy key-on event at the same time as each of the hammer event except for the final hammer event as by step S10.

Subsequently, the post treatment unit 11*t* modifies the supplemented dummy key-off event and the supplemented dummy key-on event as by step S11. Namely, even through the key sensor misses a key-on event and a key-off event, the recording unit 11*s* can determine the impact time ti and the hammer velocity VH on the basis of the hammer position signal HP, and can calculate the reference velocity Vr and the reference time interval Tr (which are described with reference to FIGS. 2–4). Therefore, it is possible to determine a linear forward trajectory for the key 10*a* in such a manner that the key 10*a* passes the reference point Xr on the linear forward trajectory at a certain time earlier than the impact time ti by the reference time interval Tr at the reference velocity Vt. In this instance, when the player depresses a key 10*a*, the key 10*a* is assumed to be moved along the linear forward trajectory under a uniform motion, and, accordingly, the dummy key-on event or the key-on time t1 is estimated at an appropriate timing when the linear line crosses the photo-interrupter of the associated key sensor 11*a*. The key velocity is further modified to be equal to the reference velocity Vr.

Moreover, the key 10*a* is assumed to return immediately after the impact at the strings 10*e*, and a dummy released key velocity is determined to be a natural released key velocity observed when the player releases the key without a force exerted by player's finger. For this reason, the key recovery time tkN is estimated at a timing when the backward trajectory crosses the photo-interrupter of the associated key sensor 11*a*.

Thus, the dummy key-off event and the dummy key-on event are supplemented, and are modified at step S11. Then, the post treatment unit 11*t* proceeds through step S7 to step S8, and carries out the tasks described hereinbefore.

3-1-4: Data Processing for Key Motion without Hammer Event

As described with reference to FIG. 7, when the player depresses a key 10*a* in the half stroke fashion, the hammer sensor 11*b* may miss the hammer event. In this case, the post treatment unit 11*t* proceeds from step S4 to step S12, and supplements the dummy hammer event at the same time as the key-on event. Subsequently, the post treatment unit 11*t* proceeds to step S13, and determines the final hammer velocity VH to be the minimum value. When the hammer assembly 10*c* strikes the set of strings 10*e* at the minimum final hammer velocity VH, the strings 10*e* hardly vibrate, and do not produce a sound. The post treatment unit 11*t* further determines the reference velocity Vr and the reference time interval Tr, and decides a linear forward trajectory for the key 10*a* in such a manner that the key 10*a* passes the reference point Xr on the linear forward trajectory at a certain time earlier than the impact time ti by the reference time interval Tr at the reference velocity Vr. The key-on event is modified so as to match with the linear forward trajectory. Thus, the post treatment unit 11*t* supplements the dummy weak hammer event, and modifies the key-on event at step S13. The post treatment unit 11*t* proceeds through step S7 to step S8, and carries out the tasks described hereinbefore.

3-1-5: Data Processing for Long Time Interval between Key-on Time and Impact Time If the time interval between the key-on time t1 and the impact time ti is too long, the key 10*a* is moved along Plots KEY5 in FIG. 10. The key 10*a* passes the detecting point L1 or the photo-interrupter of the associated key sensor 11*a* at time t21, and the key-on event KON20 takes place. However, the key 10*a* is only expected to actuate the damper assembly 10*d*, and returns toward the rest position before a strike at the strings 10*e*. For this reason, the hammer event does not take place. The key 10*a* makes to sink toward the end position around time t22 before reaching the detecting point L1, and rebounds on the strings 10*e* at time t23. The hammer sensor 11*b* detects the hammer shank at time t23, and the hammer event IMP20 takes place. Thereafter, the key 10*a* passes the detecting point L1 at time t24, and the key sensosr 11*a* detects the shutter 11*o*. The key-off event KOFF20 takes place at time t24. The key 10*a* arrives at the rest position at time t25.

Although the hammer event IMP20 takes place between the key-on event KON20 and the key-off event KOFF20, the key motion KEY5 is unusual. However, the unsual key motion KEY5 is not discriminated at step S4, and the post treatment unit 11*t* proceeds to step S5. Since the key 10*a* return on the way to the end position, the time interval between the key-on time t1 and the impact time ti is longer than the time interval for the usual key motion, and the answers at steps S6 and S9 are given affirmative. Then, the post processing unit 11*t* proceeds to step S12, and supplements the dummy weak event DI20 at time t21. As a result, two hammer events DI20 and IMP20 are inserted between the key-on event KON20 and the key-off event KOFF20, and the post treatment unit 11*t* further supplements the dummy key-off event DKOFF20 and the dummy key-on event DKON20 at time t21, and modifies the dummy key-on event DKON20 and the dummy key-off event DKOFF20 as similar to steps S10 and S11.

The post treatment unit 11*t* determines the final hammer velocity VH to be the minimum value, and modifies the key-on event as by step S13. The key-off event is also modified as described above. Upon completion of the modification, the post treatment unit 11*t* carries out the normalization and the output at steps S7 and S8 as usual.

3-1-6: Data Processing for Impact time Earlier than Key-on Time

While the player is performaing a music through a standard fingering on the keyboard, the key-on time t1 of each key 10*a* is earlier than the impact time ti, and the answer at step S5 is certainly given affirmative. However, if the player repeats a key 10*a* at extremely high speed, the recording unit 11*s* possibly determines the impact time ti before the key-on time t1 due to an unsual mutual motion between the associated key action mechanims 10*b* and the assoicated hammer assembly 10*c* followed by the shallow key depressing for actuating the damper assembly 10*d* only. In this case, the answer at step S5 is given negative, and the post treatment unit 11*t* proceeds to step S14. The post treatment unit 11*t* decides whether or not the time interval between the impact time ti and the key-on time t1 is longer than a certain value C3 at step S14. In this instance, the value C3 is 10 milliseconds. With the positive answer "Yes", the post treatment unit 11*t* proceeds to step S15, and compares the time interval with a product caplulated through a division of a contact value C4 by the hammer velocity VH. In this instance, the constant value C4 is 10 millimeters.

If the answers at steps S14 and S15 are affirmative, the post treatment unit 11*t* notices the unusual mutual motion where a high speed reciprocating motion of the key between the rest position and a position immediately before the detecting point L1 causes the hammer assembly 10*c* to reach the impact point. After the high speed repetition, if the player depresses the key 10*a* for actuating the damper assembly 10*d* without the strike, the recording unit 11*s* only determines the key-on event as to the key action between time t21 and time t22, and, as a result, the hammer event due to the unusual mutual motion takes place before the key-on event in the shallow key depressing.

Thus, there is a possibility in that the hammer event, the key-on event and the key-off event sequentially take place, and the post treatment unit 11*t* proceeds to step S10 so as to supplement the dummy key-on event and the dummy key-off event on both sides of the hammer event.

The post treatment unit 11*t* further supplements the weak dummy hammer event between the key-on event and the key-off event as similar to step S12.

If one of or both of the answers at steps S14 and S15 are given negative, the time interval is not so long, and the post treatment unit 11*t* assumes a kind of relation between the key-on event and the hammer event. In this situation, if a dummy key/dummy hammer event is supplemented, the supplemented dummy key/dummy hammer event destroys the relation between the key-on event and the hammer event, and the post treatment unit 11*t* immediately proceeds to step S7, and starts the normalization. However, the preliminary treatment unit 11*i* certainly encounters a problem in the playback mode in so far as the key-on event takes place after the hammer event, and hardly decides the original key motion. For this reason, it is recommendable to exchange the key-on event and the hammer event, and the post treatment unit 11*t* modifies the key-on event and the key-off event as similar to step S11.

As described hereinbefore, the post treatment unit 11*t* supplements the dummy key/dummy hammer events, and the supplemented dummy key/dummy hammer events possibly make the order of key/hammer events not real. In the reproduced key motion KEY4 in FIG. 7, the key-on events successively take place at time t16 and time t17, and the key-off event also successively take place at time t18 and time t19. In order to make the relation between the event in an original key motion and an event in the reproduced key motion clear, it is recommendable to add tags to the music data code signals before supplying them to the outside of the automatic playing system 11.

3-2: Playback Function

The music data code signals are stored in the external memory system (not shown) in the recording mode, and are sequentially read out therefrom in the playback mode. The music data code signals may be supplied from another external source. Each of the music data code signals is firstly supplied to the preliminary treatment unit 11*i*, and the preliminary treatment unit 11*i* generates the preliminary control data signal from the music data code signal as described hereinbefore.

3-2-1: Path for Depressed Key

Figure 11:
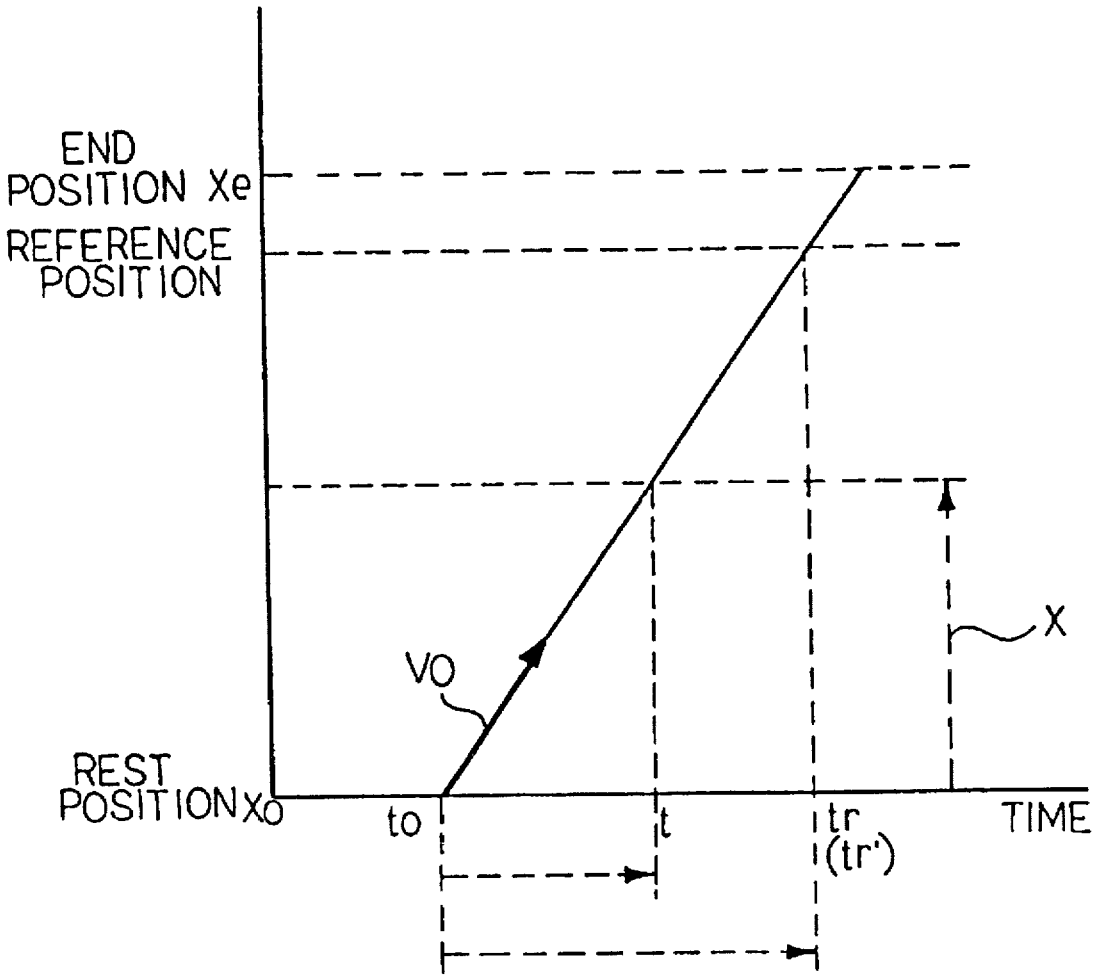
FIG. 11 is a graph showing a forward trajectory of a key assumed in the playback mode.

The preliminary treatment unit 11*i* assumes the original forward trajectory for a depressed key to be a linear line as shown in FIG. 11, and determines the expected motion of the plunger 11*m*. In detail, if the key 10*a* starts the uniform motion from the rest position Xo at time t0, the key 10*a* is moved toward the end position Xe at a constant speed V0. The key 10*b* is assumed to move over distance X and reach there at time t. The distance X is expressed as Equation 3.

$$X=V0\times t+X0 \quad \text{Equation 3}$$

The reference point Xr is given as $$Xr=V0\times tr'+X0 \quad \text{Equation 4}$$

where tr' is the reference time on the assumption that the key 10*a* starts at time zero. Solving Equation 4 for the reference time tr', the reference time tr' is expressed as $$tr'=(Xr-X0)/V0 \quad \text{Equation 4'}$$

The key-on time t0 of the depressed key 10*a* on an absolute time scale is given by Equation 5.

$$t0=tr-tr'=tr-(Xr-X0)/V0 \quad \text{Equation 5}$$

Therefore, if the solenoid-operated actuator unit 11*c* causes the plunger 11*m* to upwardly push the associated key 10*a* at time t0 and controls the distance X in accordance with Equation 3, the key 10*a* reaches the reference point Xr at the reference time tr, and the key velocity at the reference point Xr is equal to the reference velocity Vr.

In this instance, the key 10*a* is assumed to behave in the uniform motion, and the reference velocity Vr is equal to the constant key velocity V0. The music data code signal gives the hammer velocity VH, and the reference velocity Vr is calculated by using Equation 1. The reference time tr is calculated by subtracting the reference time interval Tr (see Equation 2) from the impact time ti.

3-2-2: Path for Released Key

Description is hereinbelow made on a backward trajectory of a released key 10*a*. The preliminary control data signal produced by the preliminary treatment unit 11*i* is further used for controlling a backward motion after a release of the depressed key 10*a* as follows.

Figure 12:
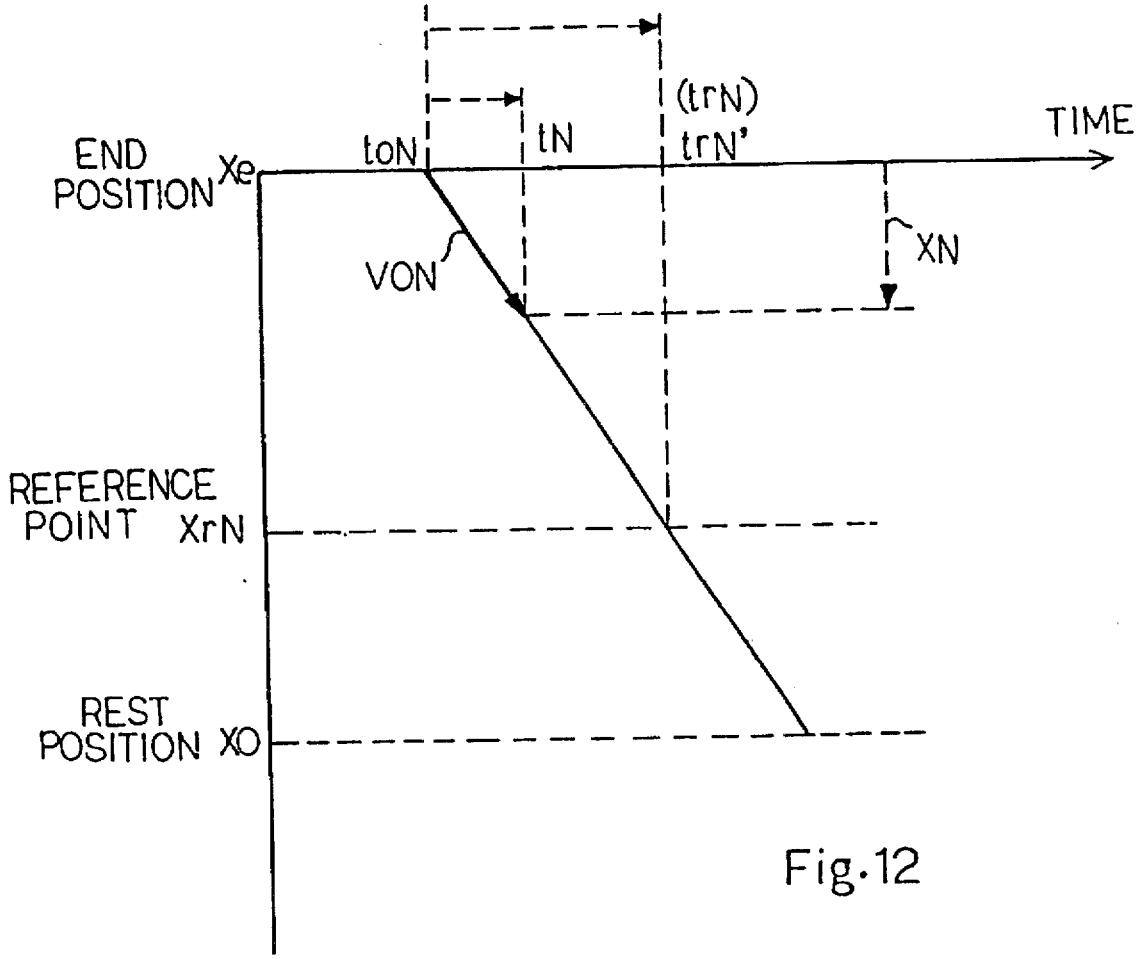
FIG. 12 is a graph showing a backward trajectory of a released key assumed in the playback mode.

A key position XN at a time tN is expressed by Equation 6.

$$XN=V0N\times tN+Xe \quad \text{Equation 6}$$

where V0N is the initial key velocity (<0) at the end position Xe. The backward trajectory represented by Equation 6 is illustrated in FIG. 12 of the drawings.

As described hereinbefore, the recording unit 11*s* calculates the released key velocity VkN on the basis of the time interval between the photo-detecting state of the lower photo-interrupter and the photo-detecting state of the upper photo-interrupter of the associated key sensor 11*a*, and decides the timing at the upper photo-interrupter to be the key recovery time tkN. The damper assembly 10*d* comes into contact with the associated set of strings 10*e* at the key recovery time tkN, and the damper assembly 10*h* starts the absorption of the vibrations on the strings 10*e*. The released key velocity VkN and the key recovery time tkN form parts of the music data code signal.

Let us assume that the damper assembly 10*d* comes into contact with the strings 10*e* at a key position on the backward trajectory defined as "released reference point XrN", the playback section 11*g* controls the released key 10*a* in such a manner as to reach the released reference point XrN at the key recovery time tkN, then the decay of the reproduced tone is approximated to the decay of the original tone.

A damper velocity at a point coming into contact with the strings 10*e* strongly affects the decay of the tone, and the damper velocity is related to the released key velocity VkN. For this reason, if the key velocity at the released reference point XrN is controlled to be matched with the released key velocity VkN, the decay of the reproduced tone faithfully traces the decay of the original tone. The key velocity at the released reference point XrN is referred to as "released reference velocity VrN".

If a key 10*a* is released at time zero, the released reference point XrN is expressed as $$XrN=V0N\times trN'+XeN \quad \text{Equation 7}$$

where trN' is a time when the released key 10*a* reaches the released reference point XrN. V0N and VrN are equal to VkN because of the uniform motion. From Equation 7, trN' is determined, and a key-off time t0N for the backward motion is given by Equation 8.

$$t0N=trN-trN'=trN-(XrN-XeN)/V0N \quad \text{Equation 8}$$

The playback section 11*g* controls the released key 10*a* from the key-off time t0N for moving the key 10*a* along the backward trajectory expressed by Equation 6. Then, the released key 10*a* passes the released reference point XrN at the key recovery time tkN. In this instance, the initial key velocity V0N is equal to the reference key velocity VkN, and the reference key velocity VkN is equal to the released reference velocity VrN. Therefore, the playback section 11*g* may control the released key 10*a* at the constant speed VkN from the key-off time t0N toward the rest position.

3-2-3: Composite Path for Repeated Key

Figure 13:
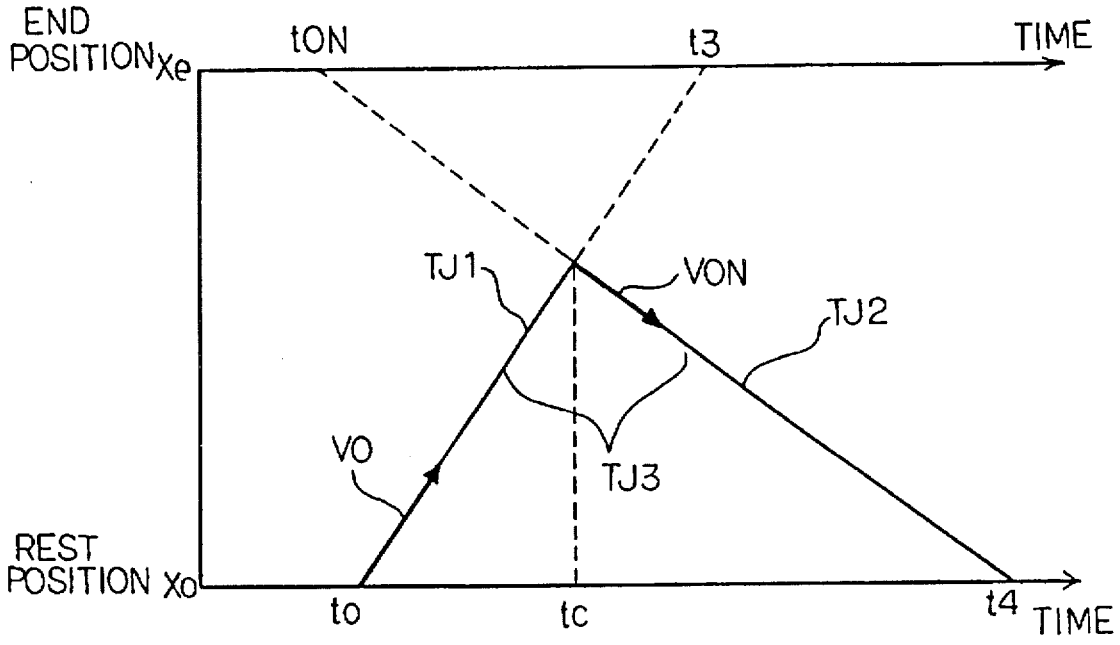
FIG. 13 is a graph showing a composite trajectory of a key assumed in the playback mode.

If a player releases a key 10*a* at an intermediate point on the way from the rest position to the end position, the half strike key 10*a* traces a composite trajectory TJ3 shown in FIG. 13. The key 10*a* starts the rest position Xo at time t0, and reaches the intermediate point at time tc. Then, the key changes the moving direction, and returns to the rest position Xo at time t4.

If the player is continuously depressing the key 10*a* without removing a force exerted on the key 10*a*, the key 10*a* will reach the end position Xe at time t3. On the other hand, if the player releases the key 10*a* at time t0N, the key will pass the intermediate point at time tc, and reach the rest position Xe at time t4.

If the time tc is determined, a part TJ1 of the forward trajectory between time t0 to tc is combined with a part TJ2 of the backward trajectory between time t0 and time t4, and the composite trajectory TJ3 is obtained.

The time tc is calculated as follows.

$$tc=(V0\times t3-V0N\times t0N)/(V0-V0N)=t0N+V0\times(t3-t0N)/(V0-V0N) \quad \text{Equation 9}$$

Equation 10 gives t3 as follows.

$$t3=t0+(Xe-X0)/V0 \quad \text{Equation 10}$$

The part TJ1 of the forward trajectory is combined with the part TJ2 of the backward trajectory at time tc, and the half stroke key 10*a* traces the composite trajectory TJ3 in the playback mode. If one of the music data code signal is indicative of the half stroke, the preliminary treatment unit 11*i* generates the preliminary control data signal indicative of the composite trajectory TJ3, and the preliminary control data signal is supplied to the motion controller 11*j* as usual.

In the case where a part of the backward trajectory crosses a part of the forward trajectory at an intermediate point, a composite trajectory is similarly generated for the half stroke key.

As described hereinbefore, the post treatment unit 11*t* supplements the dummy key-on/dummy key-off events and the dummy hammer event in the music data code signal. A forward trajectory may cross another forward trajectory, and a backward trajectory may cross another backward trajectory as shown in FIG. 7. In case where a forward trajectory crosses another forward trajectory, the forward trajectory reaching the end position earlier than the other should be selected as shown in the figure, because the selected forward trajectory faithfully reproduce a strong attack. On the other hand, after the crossing point, it is recommendable to select the backward trajectory reaching the rest position later than the other.

The motion controlling unit 11*j* generates the control data signal indicative of a series of expected positions for the plunger 11*m*, and each of the target positions X of the associated key 10*a* is varied with time in accordance with the forward/backward trajectorys represented by the preliminary control data signal.

The control data signal is supplied to the servo controlling unit 11*k*. The servo controlling unit 11*k* form a plurality of feedback loops together with the solenoid-operated actuator units 11*c* and the built-in position sensors 11*n*. The serve controlling unit 11*k* respectively supplies the driving signals DR to the solenoid-operated actuator units 11*c*, and the amount of each driving signal DR is proportional to the target position X indicated by the control data signal. Each of the solenoid-operated actuator units 11*c* projects the plunger 11*m* so as to cause the associated key 10*a* to reach the target position X, and the associated built-in position sensor 11*n* produces the feedback signal FB indicative of an actual position of the plunger 11*m* and, accordingly, an actual position of the key 10*a*. The servo controlling unit 11*k* compares each actual position with the target position X, and changes the driving signal DR in such a manner as to match the actual position with the target position X.

3-3: Examples of Reproduced Path

Figure 8:
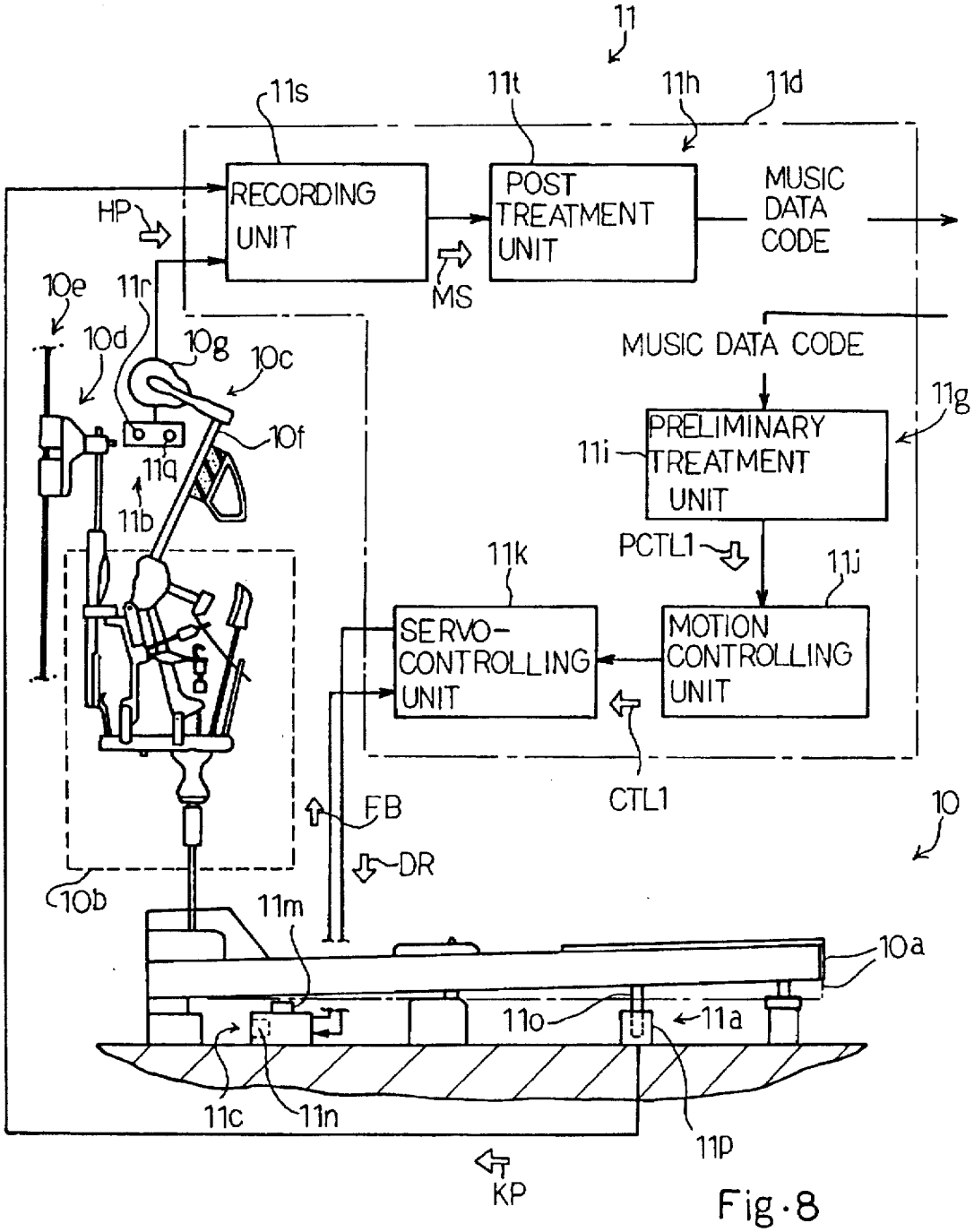
FIG. 8 is a schematic view showing the structure of an automatic player piano embodying the present invention.

Using FIGS. 6, 7 and 8 of the drawings, examples of the reproduced trajectory are described in detail.

First, the reproduced key motion KEY2 is analyzed. A forward trajectory FP1 before the impact at time t7 is representative of a uniform key motion from the rest position to the end position, and the reference velocity Vr is equal to the hammer velocity VH1. After the impact at time t7, the key 10*a* is moved along a backward trajectory BP1 at the maximum released key velocity VkN, because the dummy key-off event DKF1 is initially supplemented at the same time as the hammer event IMP1. The backward trajectory BP1 crosses a forward trajectory FP2 toward the impact at time t9. For this reason, the preliminary treatment unit 11*i* combines a part of the backward trajectory BP1 with a part of the forward trajectory FP2, and forms the composite trajectory RL1 as described hereinbefore.

While the servo-controlling unit 11*k* is controlling the solenoid-operated actuator unit 11*c* and, accordingly, the key 10*a* in accordance with the composite trajectory RL1, the key action mechanism 10*b* drives the hammer assembly 10*c* for rotation, and the hammer assembly 10*c* strikes the set of strings 10*e* twice as similar to the original performance. The reproduced impacts at times t7 and t9 are equal to the original impacts at times t2 and t4, because the hammer velocities VH1 and VH2 are imparted to the hammer assembly 10*c*.

Turning to FIG. 7, a forward FP3 trajectory and a backward trajectory BP3 cross the detecting position L1 at times t17 and t18 corresponding to times t11 and t13 in the original key motion KEY3. Since the post treatment unit 11*t* supplements the dummy weak hammer event DI10 at time t14, the preliminary treatment unit 11*i* determines a forward trajectory FP4 crossing the detecting position L1 at time t16. The forward trajectorys FP3 and FP4 successively cross the detecting point L3, and the preliminary treatment unit 11*i* selects the forward trajectory FP3 sharper than the forward trajectory FP4 as described hereinbefore.

Moreover, the backward trajectory BP3 crosses the forward trajectory FP4 at an intermediate point between the end position and the rest position, and the preliminary treatment unit 11*i* determines the composite trajectory RL2.

While the servo-controlling unit 11*k* is controlling the solenoid-operated actuator unit 11*c* and, accordingly, the key 10*a* in accordance with the composite trajectory RL2, the key action mechanism 10*b* drives the hammer assembly 10*c* for rotation, and the hammer assembly 10*c* strikes the set of strings 10*e* with the same impact as the original strike at time t12. However, the hammer assembly 10*c* only touches the set of string 10*e* at next time, and the strings 10*e* hardly vibrate. For this reason, no substantial sound is generated at the second time.

Figure 10:
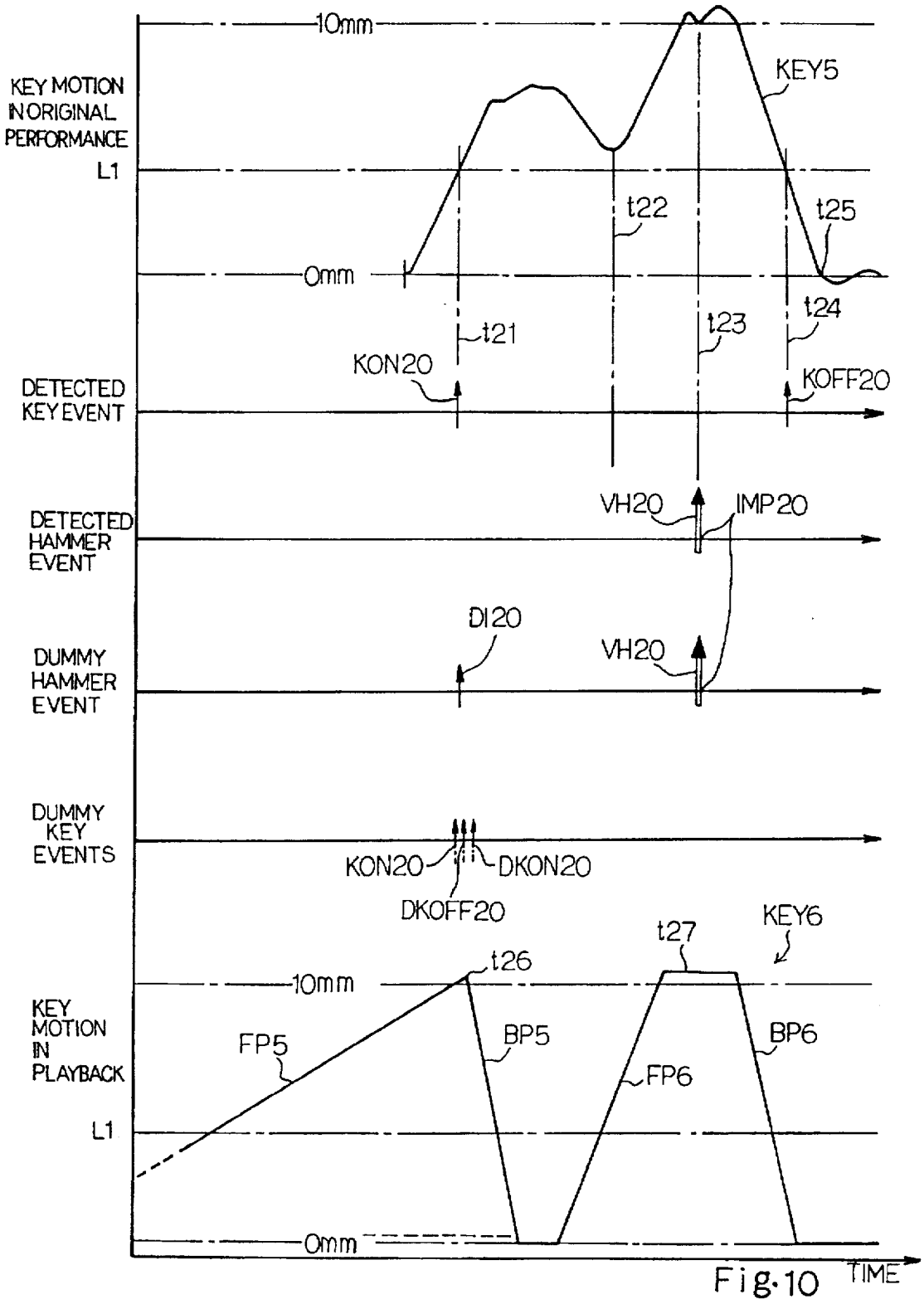
FIG. 10 is a time chart showing yet another original key motion, the detected key/detected hammer events, supplemented dummy hammer/dummy key events and a reproduced key motion.

Turning to FIG. 10 of the drawings, the key 10*a* traces a forward trajectory FP5 with a gentle sloop due to the dummy weak hammer event DI2, and changes the forward trajectory FP5 to a backward trajectory BP5 at time t26 corresponding to time t21. After time t26, the key returns to the rest position along the backward trajectory BP5 at the maximum speed. The key 10*a* is moved toward the end position along a forward trajectory FP6, and returns to the rest position through a backward trajectory BP6.

Although the key 10*a* actuates the damper assembly 10*d* on the forward trajectory FP5, the key 10*a* only touches the set of strings 10*e* at time t26, and the impact is too weak to cause the strings 10*e* to vibrate. Thus, the reproduced key motion KEY6 only actuates the damper assembly 10*d* without an acoustic tone. The key 10*a* strikes the set of strings 10*e* at time t27 with the same intensity as the original impact at time t23, because the hammer velocity in the reproduced action is equal to the original hammer velocity VH20.

3-4: Sequence in Playback Mode

Assuming now that the automatic player piano enters into the playback mode, a series of music data code signals representative of an original performance are sequentially supplied to the preliminary treatment unit 11*i*. The preliminary treatment unit 11*i* decides sets of forward/backward trajectorys and composite trajectorys as described hereinbefore, and produces the preliminary control data signals PCTL1 respectively indicative of reproduced key motions. The reproduced key motions may contain not only the standard key motions represented by sets of the key-on event, the hammer event and the key-off event but also the half stroke key motions KEY2, KEY4 and KEY6.

The preliminary control data signals PCTL1 are successively supplied to the motion controlling unit 11*j*, and the motion controlling unit produces the control data signals CTL1 each indicative of a series of expected positions of the plunger 11*m* and, accordingly, a series of target position X of the key 10*a*. The servo-controlling unit 11*k* supplies the driving currents DR corresponding to the expected positions of the plungers 11*m* to the solenoid-operated actuator units 11*c*, and compares the actual positions indicated by the feedback signals FB with the expected positions. The serve-controlling unit 11*k* controls the projection of each plunger 11*m* in such a manner as to match the actual positions with the expected positions through the feedback loop, and the keys 10*a* changes the positions X from the rest position to the end position as indicated by Equation 3.

The motion controlling unit 11*j* further produces the control data signals CTL1 each indicative of the target position XN expressed by equation 6, and the servo-controlling unit 11*k* controls the amount of each driving current DR through the feedback loop. For this reason, the keys 10*a* return the respective rest positions, and the original performance is faithfully reproduced.

As will be appreciated from the foregoing description, the post treatment unit 11*t* supplements the dummy key-on/dummy key-off events and the dummy hammer event in the music data code signal, and the playback section 11*g* reproduces the half stroke key motions KEY2 and KEY4 and the actuation of the damper assembly 10*d* without an acoustic sound. Thus, the automatic player piano implementing the first embodiment faithfully reproduces the original performance.

Second Embodiment

Figure 14:
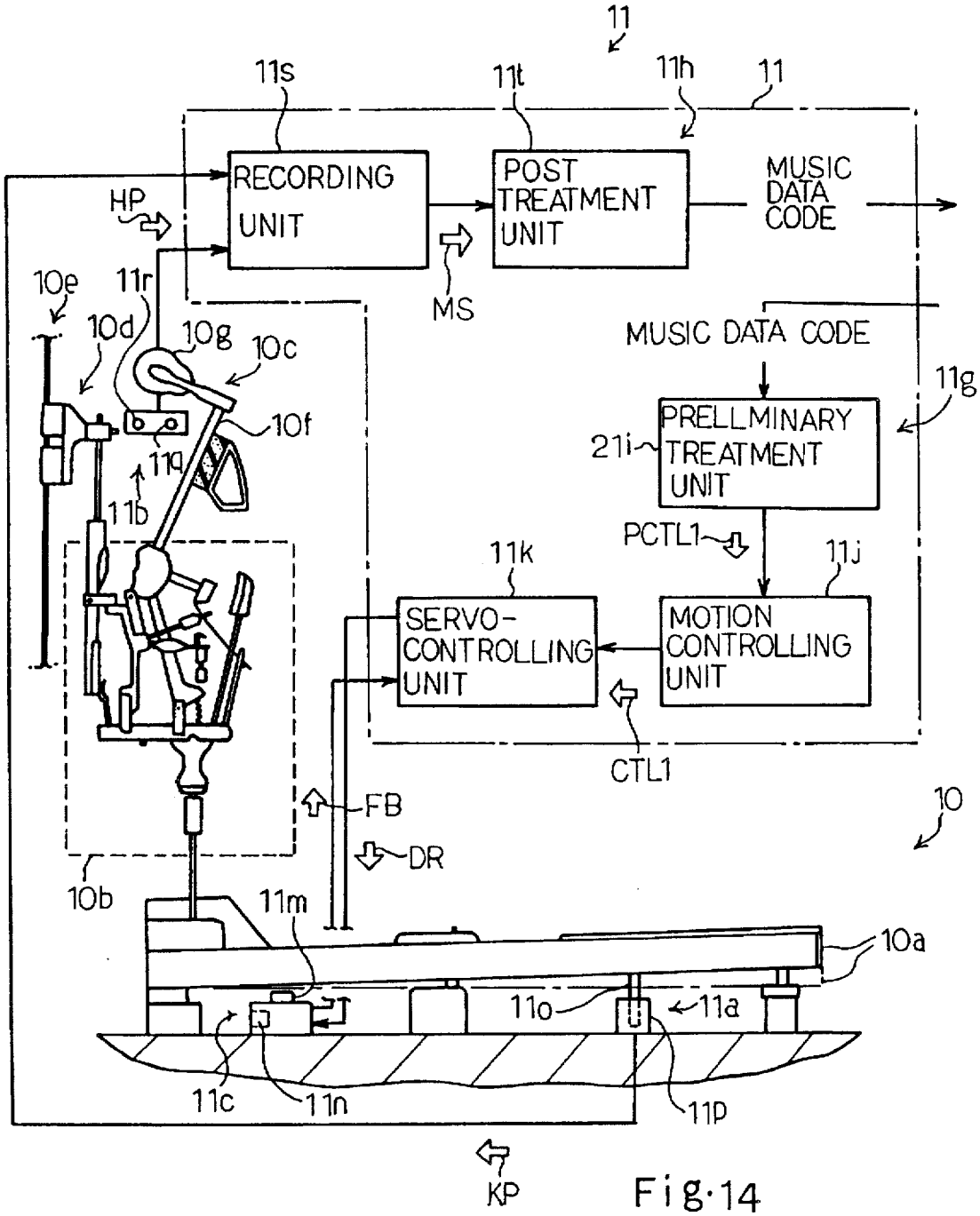
FIG. 14 is a schematic view showing the structure of another automatic player piano according to the present invention.

Referring to FIG. 14 of the drawings, an automatic player piano implementing the second embodiment is similar in structure to the first embodiment except for a preliminary treatment unit 21*i*, and description is omitted for avoiding repetition.

1: Control Principle 1-1: Forward Key Motion

Figure 15:
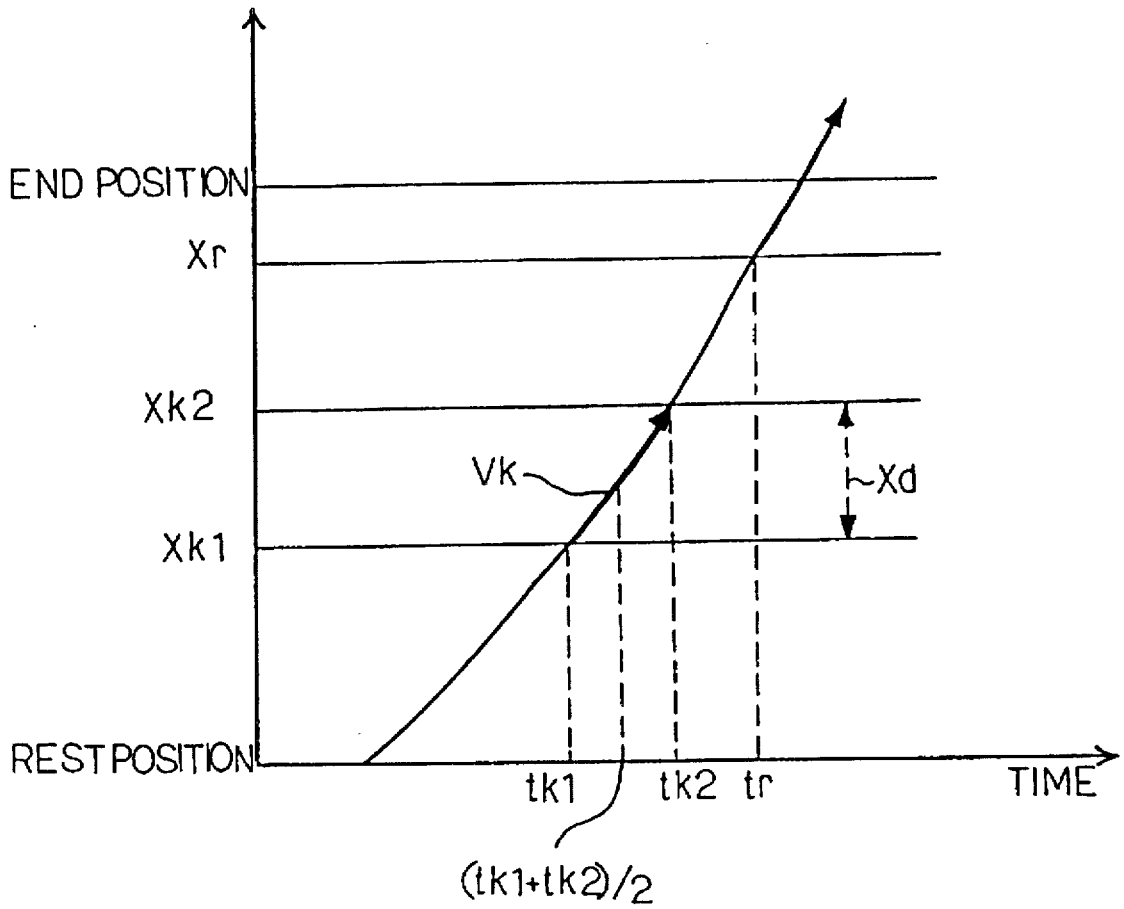
FIG. 15 is a graph showing a parabolic forward trajectory of a key assumed in the playback mode for another automatic player piano according to the present invention.
Figure 16:
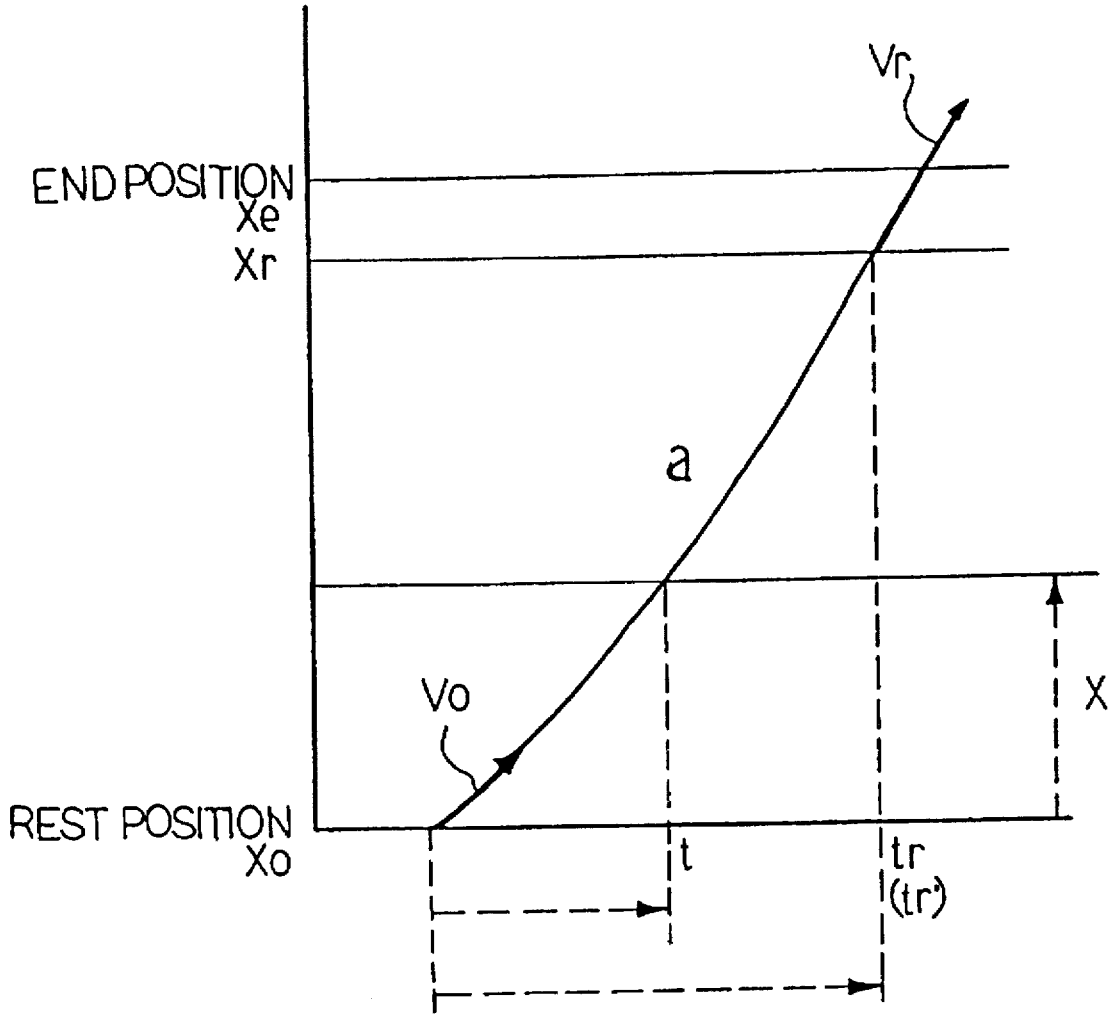
FIG. 16 is a graph showing the parabolic forward trajectory for calculating an acceleration of the key.

The preliminary treatment unit 21*i* assumes a forward trajectory of the key 10*a* to be a parabola as shown in FIG. 15. Assuming now that the released key 10*a* has an initial key velocity V0 as shown in FIG. 16, the key position X on the forward trajectory is expressed by Equation 11.

$$X=a/2\times t^2+b\times t+c \qquad \text{Equation 11}$$

where a is an acceleration and is given by Equation 12.

$$a=(Vr-Vk)/(tr-(tk1+tk2)/2) \qquad \text{Equation 12}$$

The reference velocity Vr is given by Equation 1, and is calculated on the basis of the hammer velocity vH. The time tk1 is indicative of a timing when the shutter plate 11*o* interrupts the optical radiation of the upper photo-interrupter and calculated on the basis of the key-on velocity Vk and the key-on time tk2 as follows.

$$tk1=tk2-Xd/Vk \qquad \text{Equation 13}$$

where Xd is a distance between the upper photo-interrupter and the lower photo-interrupter of each key sensor 11*a*. The parabolic forward trajectory is illustrated in FIG. 15, and Xk1 and Xk2 are indicative of the position of the upper photo-interrupter and the position of the lower photo-interrupter. The key-on velocity Vk is an average velocity across the interval between the upper photo-interrupter and the lower photo-interrupter, and is equal to the key velocity at an intermediate point (tk1+tk2)/2 on the parabolic forward trajectory.

The acceleration a is given as a quotient of the division between the velocity difference (Vr−Vk) and the time difference (tr−(tk1+tk2)/2). The acceleration a may be calculated from a velocity difference between two arbitrary points under the conditions of a uniformly accelerated motion.

Thus, the preliminary treatment unit 21*i* determines the reference time tr and the reference velocity Vr on the basis of the hammer velocity VH and the impact time ti and the acceleration a on the basis of the key-on velocity Vk and the key-on time tk2. For this reason, if a key-on time t0 of a depressed key 10*a* and an initial velocity V0 at the key-on time t0 are given, the parabolic forward trajectory shown in FIG. 15 is determined. The constants b and c of Equation 11 ares given by Equations 14 and 15.

$$b=V0-a\times t0 \qquad \text{Equation 14}$$

$$c=Xo-(a/2)\times t0^2+b\times t0 \qquad \text{Equation 15}$$

where Xo is the rest position. If the key-on time t0 is zero, Equation 11 is changed by using Equations 14 and 15 as follows.

$$Xr=(a/2)tr'^2+V0\times tr'+Xo \qquad \text{Equation 16}$$

where tr' is the reference point on the assumption that the key-on time t0 is zero. The reference velocity Vr is expressed as Equation 17.

$$Vr=a\times tr'+V0 \qquad \text{Equation 17}$$

From Equations 16 and 17, we obtain Equation 18.

$$0=(a/2)\times tr'^2-Vr\times tr'-(Xo-Xr) \qquad \text{Equation 18}$$

When Equation 18 is solved for tr', tr' is expressed as $$tr'=(Vr-(Vr^2+2a(Xo-Xr))^{1/2})/a \qquad \text{Equation 19}$$

Thus, if the acceleration a, the reference velocity Vr, the reference point Xr and rest position Xo are known, we can determine the time tr' consumed by the motion from the key-on time t0 to the reference point Xr. The relation between tr' and tr is given by Equation 20.

$$tr'=tr-t0 \qquad \text{Equation 20}$$

Using equation 20, the key-on time t0 is determined. The initial velocity V0 is calculated by using Equations 16 and 17.

$$V0=(Vr^2+2a(Xo-Xr))^{1/2} \qquad \text{Equation 21}$$

The constant b is given by Equation 14 on the basis of the initial velocity V0, and Equation 15 gives the constant c. Then, the constants b and c and the acceleration a allows Equation 11 to determine the target position X on the parabolic forward trajectory for a depressed key 10*a*.

An actual fingering on the keyboard 10*a* moves the keys 10*a* along forward trajectorys well approximated to parabolic lines. For this reason, the preliminary treatment unit 11*i* generates the parabolic forward trajectorys for depressed keys 10*a*, and the playback section 11*g* causes the acoustic piano to reproduce delicate musical expression by using the parabolic forward trajectorys.

Finally, if the playback section 11*g* starts the plunger 11*m* of the solenoid-operated actuator unit 11*c* with the initial velocity V0 at time t0 and, thereafter, increments the key velocity, the plunger 11*m* and the key 10*a* trace respective parabolic forward trajectorys, and achieve the same advantages described hereinbefore.

1-2: Backward Key Motion

The preliminary treatment unit 11*i* further determines the backward trajectory for each released key 10*a*. The calculation is similar to that of the first embodiment, and description is omitted for the sake of simplicity.

1-3: Half Stroke Key Motion

When one of the music data codes is indicative of a half stroke key motion, the preliminary treatment unit 11*i* calculates a turning point or a time tc as follows.

$$tc=(-db+(db^2-2\times da\times dc)^{1/2})/da \quad \text{Equation 22}$$

where da, db and dc are given by Equations 23, 24 and 25, respectively.

$$da=a-aN \quad \text{Equation 23}$$

where aN is an acceleration of the released key.

$$db=Vr-VrN-(a\times tr-aN\times trN) \quad \text{Equation 24}$$

The acceleration aN is zero, and Equation 24 is rewritten as $$db=Vr-VrN-a\times tr \quad \text{Equation 24'}$$

$$dc=Xr-XrN+(a\times tr^2-aN\times trN^2)/2-(Vr\times tr-VrN\times trN)=Xr-XrN+(a\times tr^2)/2-(Vr\times tr-VrN\times trN) \quad \text{Equation 25}$$

Using da, db and dc, Equation 22 gives the time tc, and the preliminary treatment unit 11*i* combines the parabolic forward trajectory with the linear backward trajectory at time tc. The composite trajectory thus combined represents the half stroke key, and the motion controlling unit 11*j* and the servo controlling unit 11*k* control the plunger 11*m* and, accordingly, the key 10*a* along the composite trajectorys.

2: Recording/Playback Functions

The recording function of the automatic player piano is similar to that of the first embodiment, and no further description is incorporated hereinbelow.

The playback function is slightly different from that of the first embodiment, and description is focused on the difference only.

After the original performance, if the player wants to reproduce the original performance, the preliminary treatment unit 11*i* sequentially reads out the music data code signals, and determines the parabolic forward trajectory for each depressed key 10*a* and the linear backward trajectory for the released key 10*a*.

Namely, the preliminary treatment unit 11*i* calculates a parabolic forward trajectory on the basis of the hammer velocity VH, the impact time ti, the key-on velocity Vk and the key-on time tk2, and supplies the preliminary control data signal PCTL1 indicative of the parabolic forward trajectory to the motion controlling unit 11*j* at the key-on time t0.

The motion controlling unit 11*j* varies the control data indicative of the expected position of the plunger 11*m* and, accordingly, the target position X of the depressed key 10*a* with time, and supplies the control data signal CTL1 to the servo-controlling unit 11*k*. The servo controlling unit 11*k* changes the driving signal DR or the amount of driving current depending upon the expected position of the plunger 11*m*. The solenoid-operated actuator unit 11*c* projects the plunger 11*m* depending upon the amount of the driving current, and the built-in position sensor 11*n* feedbacks the actual position of the plunger 11*m* to the servo-controlling unit 11*k*. The servo controlling unit 11*k* modifies the driving signal DR so as to match the expected position with the actual position. As a result, the key 10*a* specified by the read-out music data code signal is moved along the parabolic forward trajectory, and passes the reference point Xr at the reference velocity Vr and the acceleration a at the reference time tr. The depressed key 10*a* actuates the key action mechanism 10*b*, and the key action mechanism 10*b* drives the hammer assembly 10*c* for rotation. The hammer assembly 10*c* strikes the set of strings 10*e* at the hammer velocity VH, and the intensity of the impact is approximately equal to that of the original impact. The reproduced parabolic forward trajectory is analogous to the original forward trajectory, and the original performance is faithfully reproduced by the automatic player piano.

The pretreatment unit 32*r* further calculates the linear backward trajectory on the basis of the released key velocity VkN and the key recovery time tkN, and supplies the preliminary control data signal PCTL1 indicative of the linear backward trajectory to the motion controlling unit 11*j* at the key-off time t0N for the released key 10*a*. The motion controlling unit 11*j* changes the target position XN in accordance with the given linear backward trajectory, and the servo-controlling unit 11*k* causes the released key 10*a* to trace the linear backward trajectory. The released key 10*a* allows the damper assembly 10*d* to come into contact with the set of strings 10*e* at the key recovery time tkN. The return timing and the returning velocity of the damper assembly 10*d* are approximately equal to those of the damper assembly 10*d* in the original performance, and the reproduced tone is decayed as similar to the originally produced tone.

If one of the music data code signals is indicative of the half stroke key, the preliminary treatment unit 11*i* calculates the parabolic forward trajectory and the linear backward trajectory, and determines the time tc (see equation 22). The parabolic forward trajectory is merged with the linear backward trajectory at time tc, and the motion controlling unit 11*j* and the servo controlling unit 11*k* control the solenoid-operated actuator 11*c* so as to trace the composite trajectory.

Figures 17A, 17B, 17C:
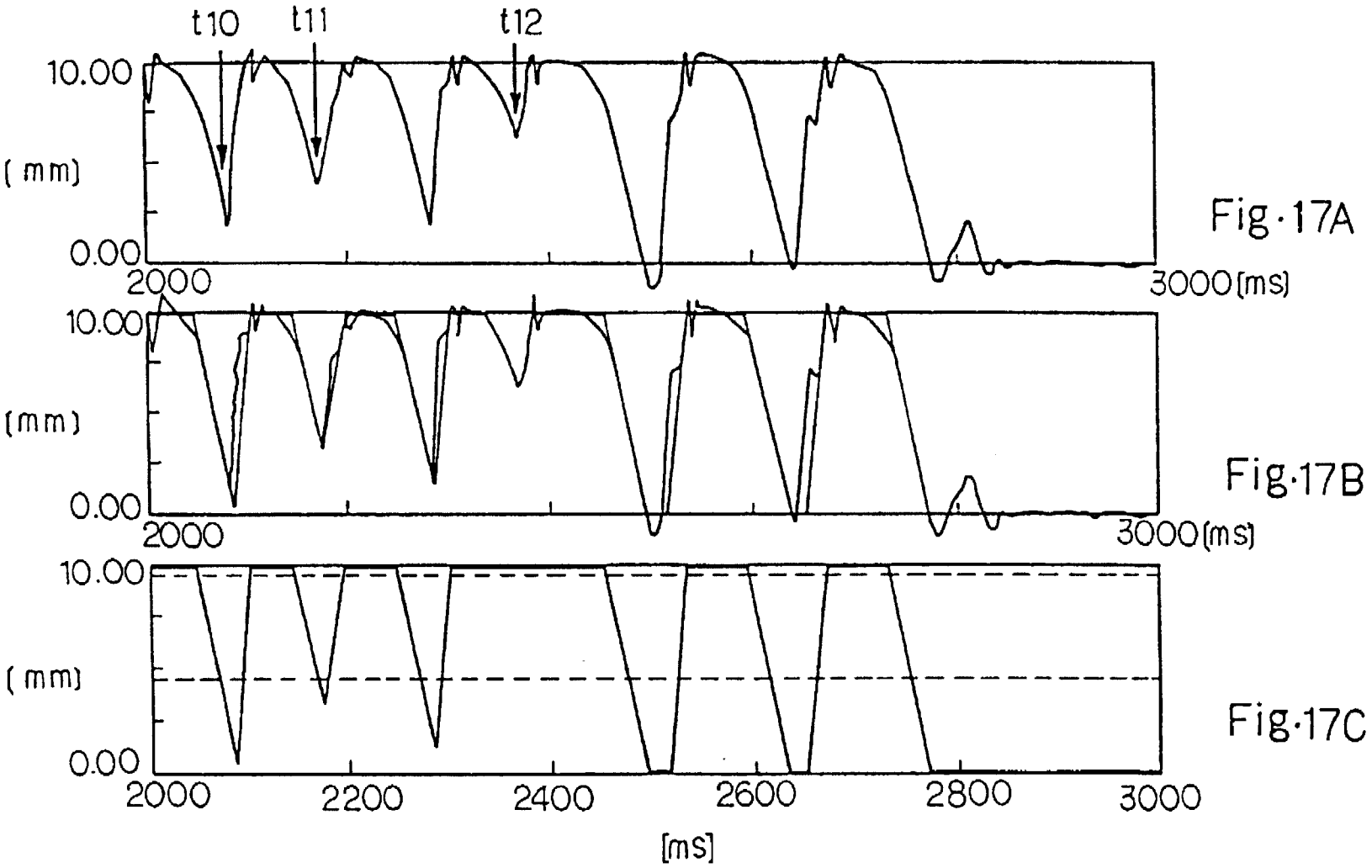
FIGS. 17A to 17C are graphs showing a detected original key motion and a reproduced key motion.

The present inventors evaluated the automatic player piano according to the present invention, and plotted detected trajectorys of the keys 10*a* in FIGS. 17A to 17C. The axes of ordinates are indicative of a distance from the rest position, and the axes of abscissa are indicative of time. FIG. 17A shows the original key motions, and t10 and t11 indicate the half stroke keys. Time t12 indicates a key motion which did not strike the strings.

Figures 18A, 18B, 18C:
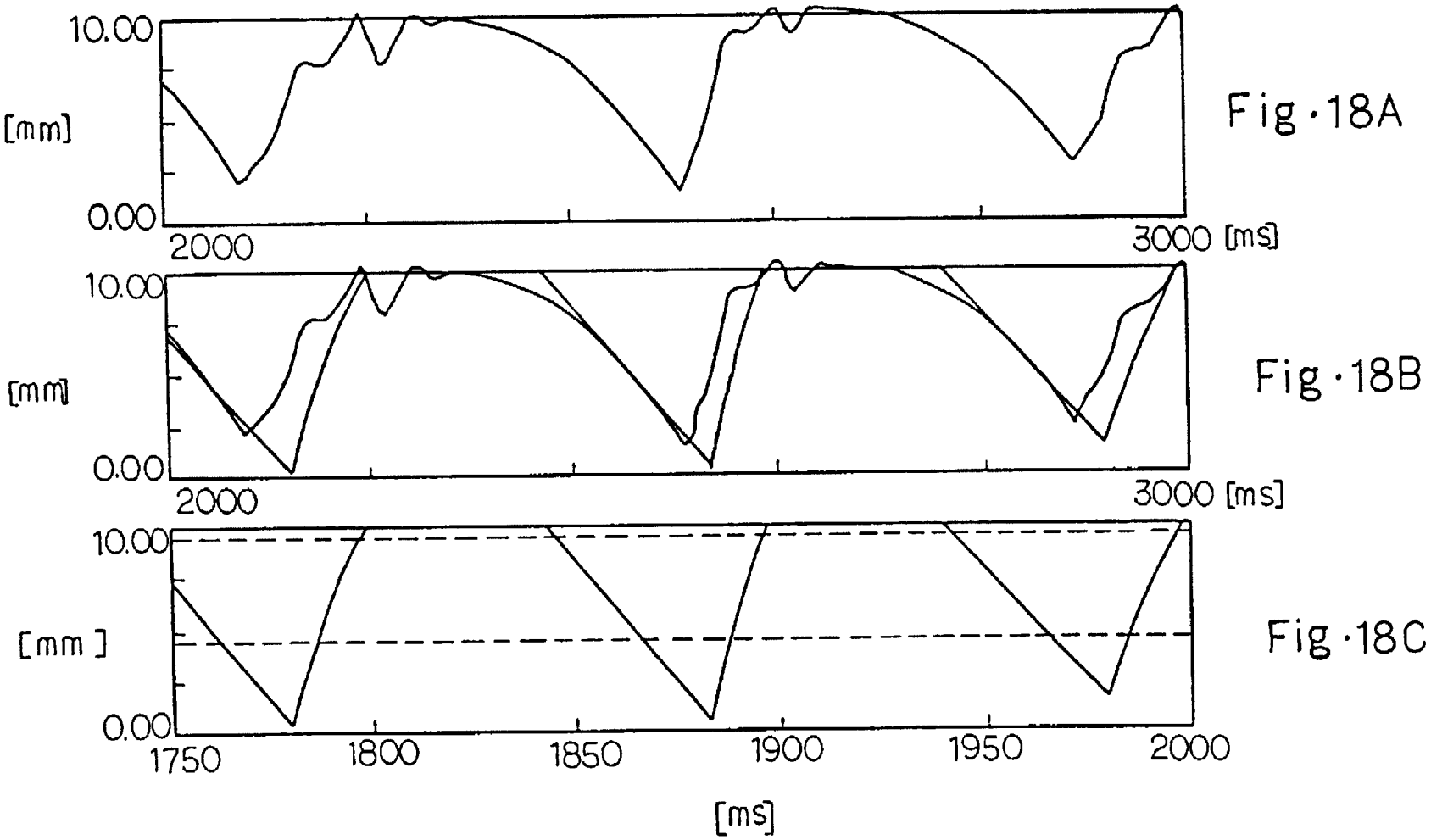
FIGS. 18A to 18C are graphs showing a part of the detected original key motion and a part of the detected reproduced key motion shown in FIGS. 17A to 17C.

FIG. 17C shows the key motion reproduced by using the impact time ti, the final hammer velocity VH, the key-on time tk2, the key-on velocity Vk, the key recovery time tkN and the released key velocity VkN, and the original key motion is overlapped with the reproduced key motion in FIG. 17B. The half stroke keys at time t10 and t11 were exactly reproduced, and the key maintained the depressed state in the reproduced key motions for the key state at time t12. Parts of the key motions shown in FIGS. 17A to 17C are scaled up as shown in FIG. 18A to 18C. Although the reproduced key motion is rather smooth than the original key motion, the original key motion was affected by unintentionally noise due to, for example, the key action mechanism 10*b*, and the present inventors think that the ideal key motion without the noise is closer to the reproduced key motion.

From FIGS. 17B and 18B, it is understood that the original key motion is well approximated to the reproduced key motion, and the automatic player piano according to the present invention is confirmed to be advantageous over the prior art automatic player piano.

3: Modifications of Second Embodiment

The automatic player piano implementing the second embodiment is modified as follows.

3-1: Separating Timing of Damper Assembly

The first modification controls a separating timing of each of the damper assemblies 10*d*. After the separation of the damper assemblies 10*d*, the sets of strings 10*e* are allowed to vibrate, and are resonant with other strings 10*e* already struck by the associated hammer assembly 10*c*. The resonant tones are not ignoreable, and, for this reason, the first modification controls the separating timings of the damper assemblies 10*d* as follows.

Figure 19:
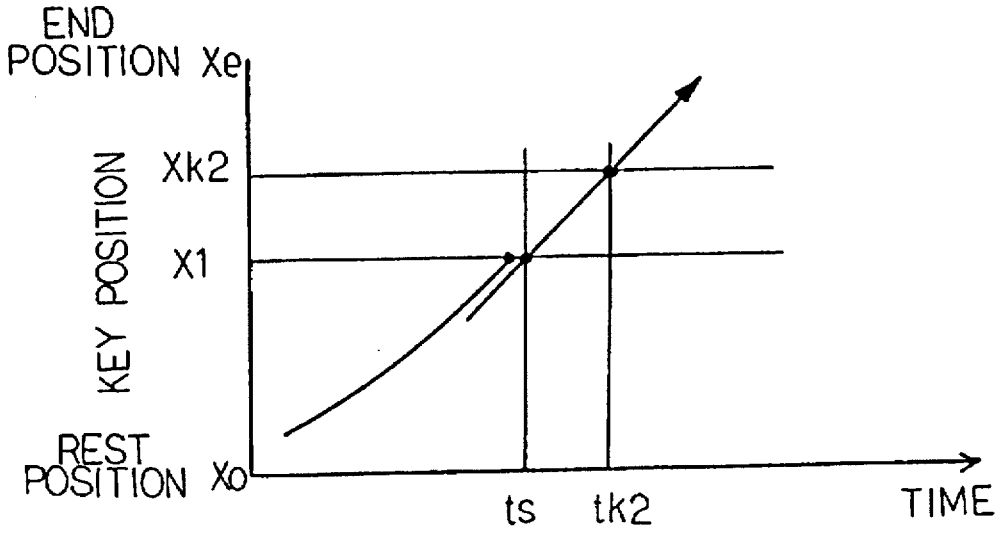
FIG. 19 is a graph showing a relation between a depressed key and a actuated damper assembly.

When the shutter plate 11*o* interrupts the optical radiation of the lower photo-interrupter at the key-on position Xk2, the damper assembly 10*d* is assumed to leave the set of strings 10*e* at a separating position X1 as shown in FIG. 19. A line is drawn in parallel to the key-on velocity Vk, and a separating time ts is determined at a crossing point between the line and a horizontal line at the separating position X1. The separating time ts is given by Equation 26.

$$ts=tk2-(Xk2-X1)/Vk \qquad \text{Equation 26}$$

Figure 20:
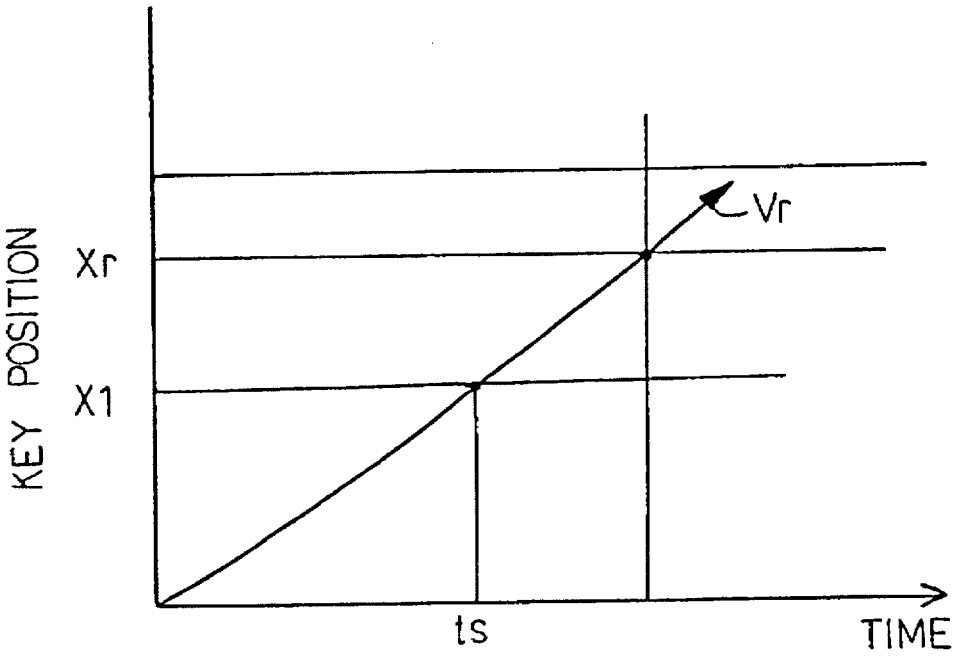
FIG. 20 is a graph showing a forward trajectory of a key in which the separating timing of the damper assembly is taken into account.

If the separating time ts is determined, the reference velocity Vr and the reference time tr are calculated as similar to the above described embodiment, and determines a parabolic trajectory shown in FIG. 20. The parabolic forward trajectory is expressed as $$X=(((X1-Xr)-Vr\times(ts-tr))/(ts-tr)^2)t^2+Vr\times t \qquad \text{Equation 27}$$

Therefore, the motion controlling unit 11*j* and the servo controlling unit 11*k* control the solenoid-operated actuator unit 11*c* such that the key 10*a* traces the parabolic forward trajectory. Thus, the damper assembly 10*d* is separated at the same timing as that in the original performance, and the resonance of other strings 10*e* are well controlled in the first modification.

3-2: Constant Acceleration

In the second modification, the preliminary treatment unit 11*i* assumes the acceleration a to be constant. The constant value is determined through experiments. If the acceleration is constant, equation 12 is useless, and the constant acceleration makes the calculation for the parabolic forward trajectory simple. The present inventors statistically confirmed an appropriate constant acceleration to be 2.5 meter/second$^2$.

Figures 21A, 21B, 21C:
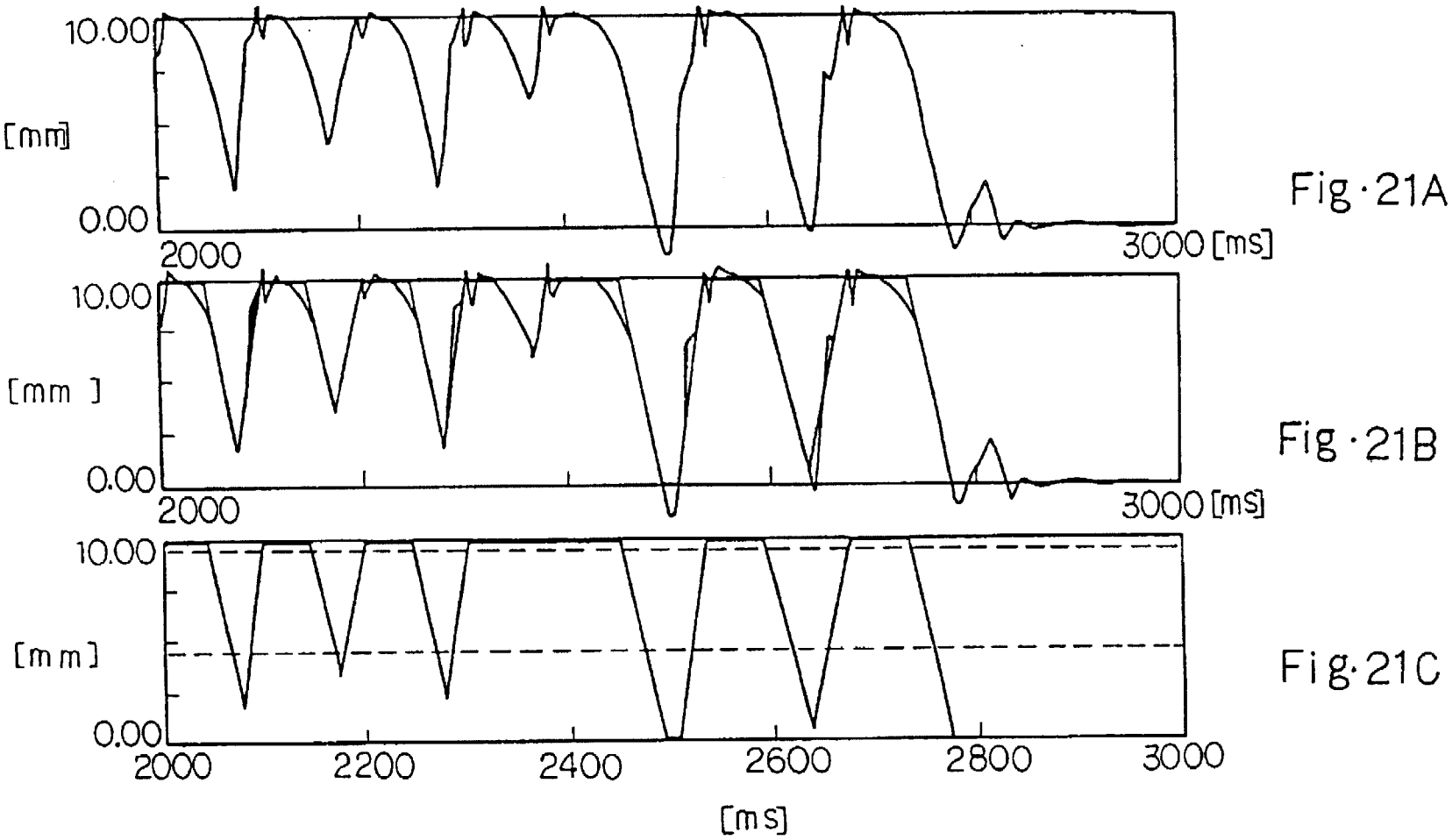
FIGS. 21A to 21C are graphs showing a detected original key motion and a reproduced key motion determined on the assumption of a constant acceleration.
Figures 22A, 22B, 22C:
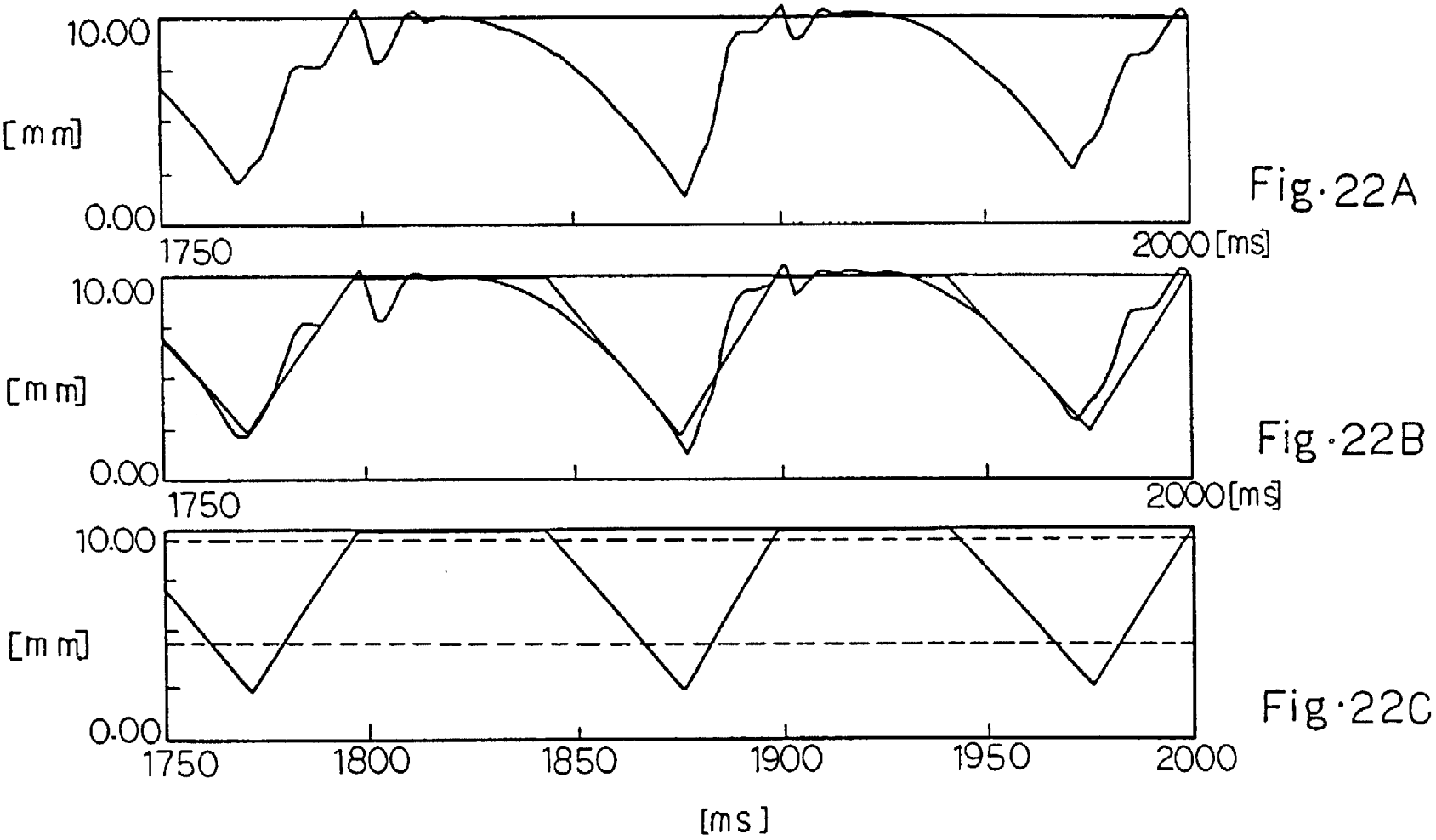
FIGS. 22A to 22C are graphs showing a part of the detected original key motion and the reproduced key motion shown in FIGS. 21A to 21C.

FIGS. 21A to 21C illustrates an original key motion, the original key motion overlapped with a reproduced key motion and the reproduced key motion on the assumption that the acceleration is fixed to 2.5 m/s$^2$. Parts of the key motions are scaled up, and are illustrated in FIGS. 22A to 22C.

The original key motion was well approximated to the reproduced key motion, and the assumption, i.e., the constant acceleration does not deteriorate the faithfulness of the reproduced performance.

3-3: Constant Initial Velocity

In the third modification, the initial velocity V0 is assumed to be a constant value. The assumption allows the preliminary treatment unit 11*i* to calculate the parabolic forward trajectory through equation 11 without the calculation of equation 21.

Figures 23A, 23B, 23C:
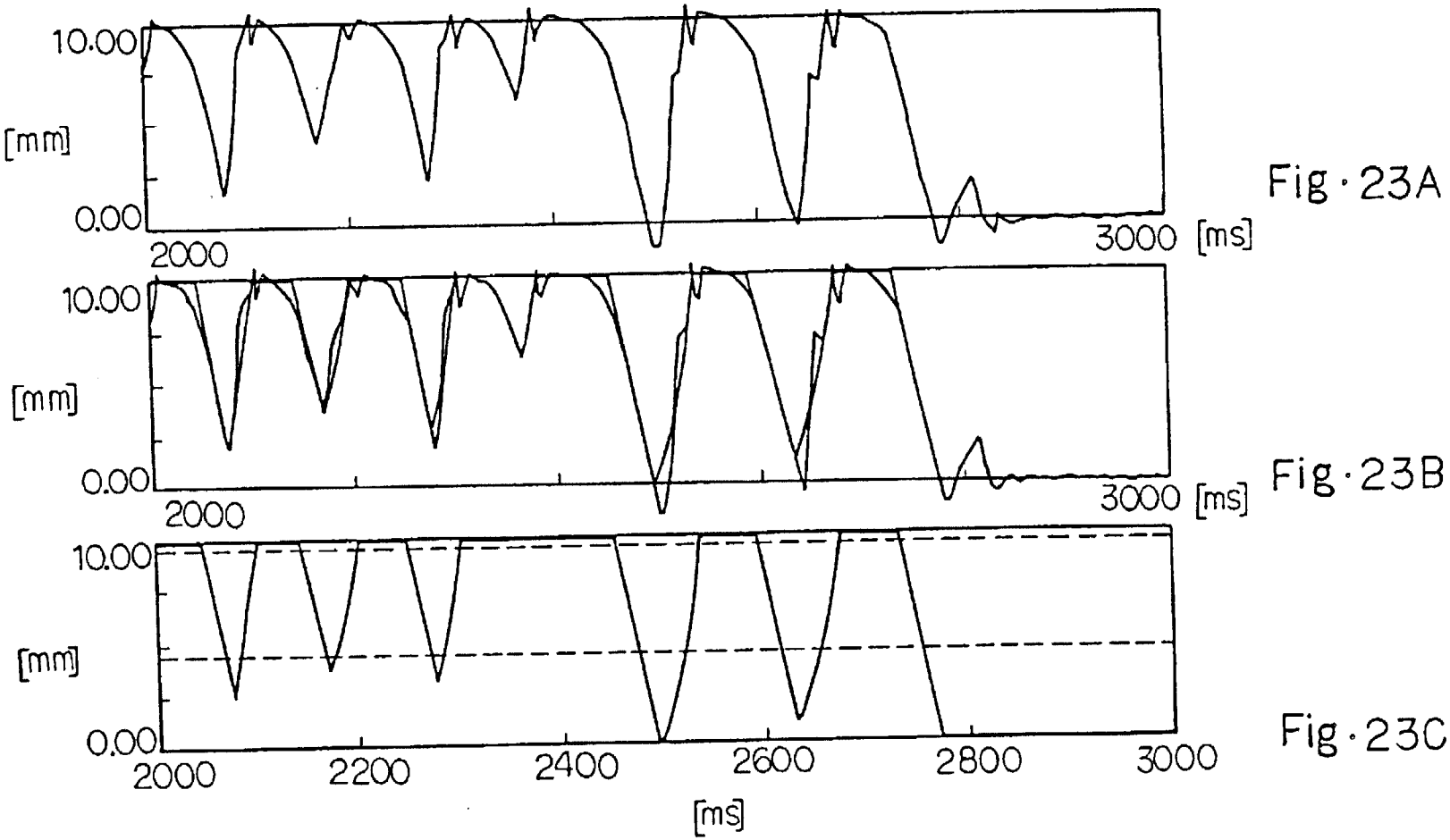
FIGS. 23A to 23C are graphs showing a detected original key motion and a reproduced key motion determined on the assumption of a constant initial velocity.

When the initial velocity V0 was assumed to be 0.1 meter/second, a key 10*a* was moved along the trajectory shown in FIG. 23A, and the key motion was reproduced as shown in FIG. 23C. The original key motion was overlapped with the reproduced key motion in FIG. 23B. Parts of the key motions are scaled up, and are shown in FIG. 24A to 24C.

Figures 24A, 24B, 24C:
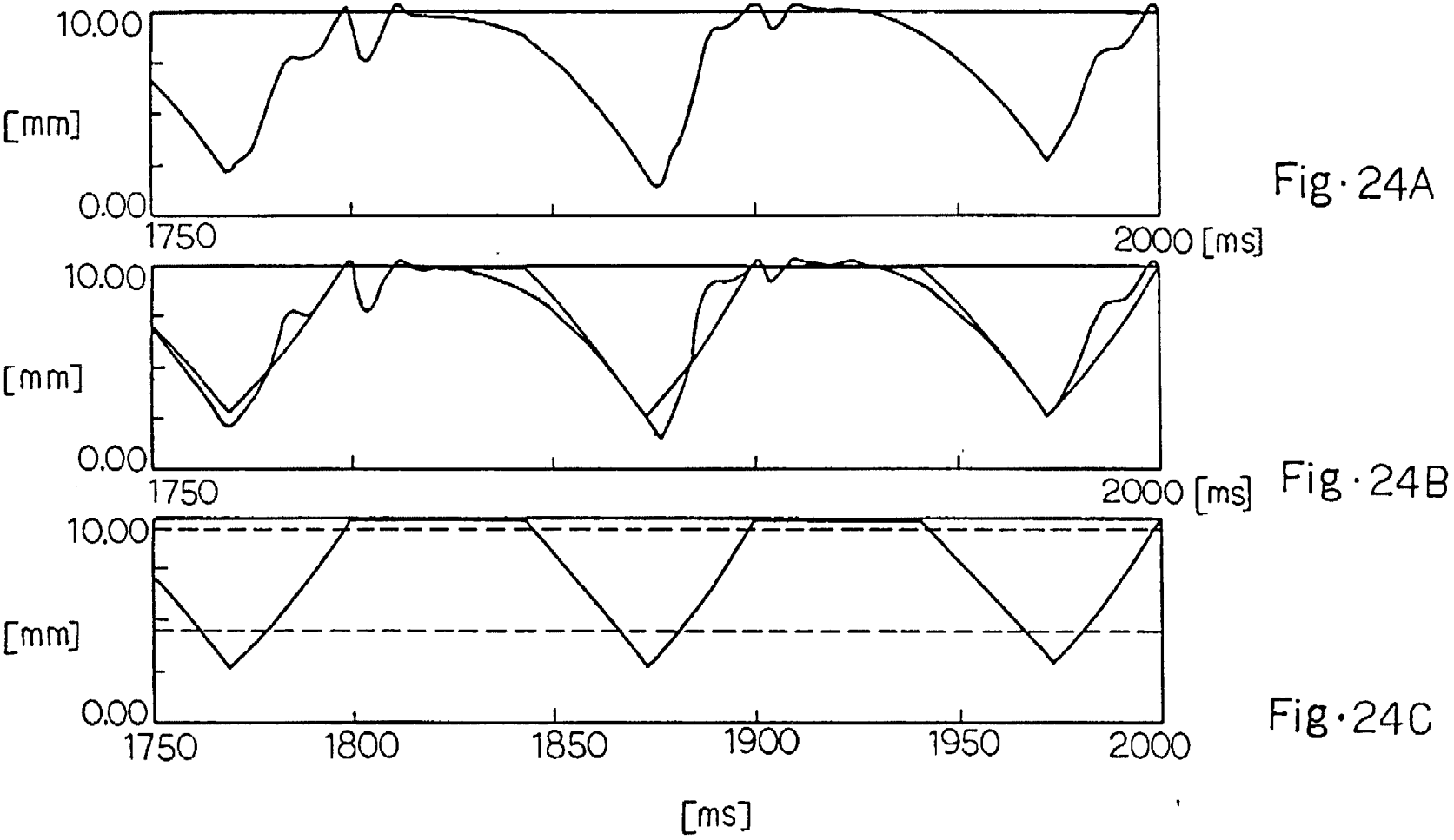
FIGS. 24A to 24C are graphs showing a part of the detected original key motion and the reproduced key motion shown in FIGS. 23A to 23C.

As will be understood from FIGS. 23B and 24B, the original key motion is well approximated to the reproduced key motion, and the approximation of the constant initial velocity makes the calculation simple.

Third Embodiment

1: Control Principle 1-1-1: Real-Time Reproduction

The first and second embodiments described hereinbefore generate the music data code signals, and store the music data code signals in the external memory system (not shown). An automatic player piano implementing the third embodiment can output the music data code signals through a real-time operation. If the music data code signals are supplied to another automatic player piano during a performance on the keyboard by a player, the automatic player piano placed in a distant room concurrently reproduces the performance.

In order to realize the real-time performance, the automatic player piano serving as a data source is expected to have a recording unit and a post treatment unit executing respective real-time data processing operations, and the automatic player piano serving as a data sink is expected to have a preliminary treatment unit executing a data processing in a real-time fashion. First, let us consider the following requirements of the real-time performance.

1-1-2: Time Delay Introduced in Real-Time Performance

The automatic player piano implementing the third embodiment calculates the forward trajectorys on the basis of the hammer velocity VH and/or the key-on velocity Vk, and determines the backward trajectorys on the basis of the released key velocity VkN and the key recovery time tkN as similar to the first and second embodiments. This means that time delay should be introduced in the real time performance of the automatic player piano serving as the data sink. The automatic player piano serving as the data source is hereinbelow referred to as "master automatic player piano", and the automatic player piano or pianos serving as the data sink are referred to as "slave automatic player piano".

In detail, if a key of the master automatic player piano is depressed, the associated key sensor detects the variation of key position, and the recording unit determines the key-on time and the key-on velocity. The depressed key causes the key action mechanism to rotate the hammer assembly, and the recording unit decides the hammer velocity and the impact time on the basis of the hammer position signal supplied from the hammer sensor. As described in conjunction with the first and second embodiments, the post treatment unit fetches the preliminary music data in the recording unit, and supplements the dummy key/dummy hammer events, if necessary. Thereafter, the post treatment unit produces the music data code signal, and the music data code signal is supplied to the preliminary treatment unit of the slave automatic player piano or pianos. The preliminary treatment unit of the slave automatic player piano calculates the forward/backward trajectorys or the composite trajectory, and the motion controlling unit and the servo-controlling unit actuate the corresponding key by means of the solenoid-operated actuator unit. Thus, the music data code signal is supplied to the slave automatic player piano after the impact of the hammer assembly of the master automatic player piano, and time delay is inherently unavoidable between the master automatic player piano and the slave automatic player piano. Especially, the time consumption of the post treatment unit is variable depending upon the supplement of the key/hammer event, because the supplement of the key/hammer event is followed by the modification of the hammer/key event.

For this reason, the automatic player piano implementing the third embodiment provides a time code to each key/hammer event, and keeps a relative time difference between the key/hammer events. The time delay is equal to the total of the maximum time interval between a key actuation time and the impact time, the time period for calculating the forward/backward trajectorys and the time period consumed by the post treatment unit. The former two time periods are described hereinbelow.

1-1-2-1: Maximum Time Interval

The maximum time interval between the actuation time and the impact time is slightly longer than "C2/key velocity" (see FIG. 9A). The post treatment unit 11*t* makes a decision for the time interval between the key-on time and the impact time at step S9, and the time interval between the actuation time and the impact time is longer than the time interval between the key-on time and the impact time. In order to determine the maximum value, it is necessary to decide the minimum value of the key depressing velocity, and the minimum value is determined in such a manner as not to cause the hammer assembly 10*c* to generate an audible sound. Even if the detected key depressing velocity is smaller than the minimum value, the key depressing velocity is assumed to be the minimum value.

1-1-2-2: Time Interval Consumed by Calculation for Forward/Backward Paths

The preliminary treatment unit 11*i* is expected to concurrently calculate forward/backward trajectorys for a plurality of keys 10*a* depressed together, and the time interval consumed by the actual calculation of the forward/backward trajectorys for each key-on event is assumed to be several times longer than the time interval theoretically consumed for each key-on event.

1-1-3: Rearrangement of Event Data

While the automatic player piano is reproducing an original performance, the preliminary treatment unit 11*i* follows the order of events by using the time code. A standard automatic player piano records the events in time order, and retrieves the events in the recording order.

Figure 25:
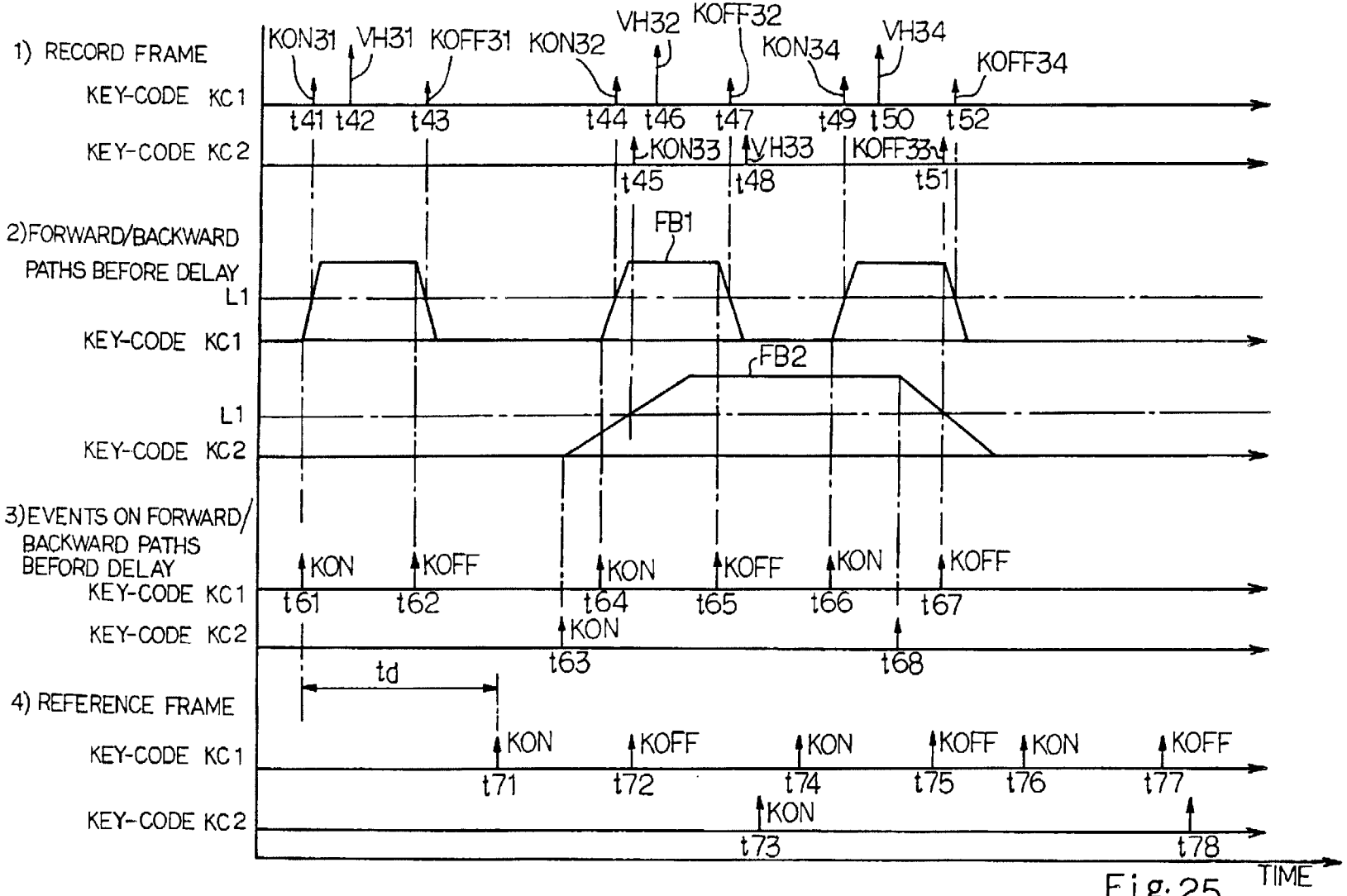
FIG. 25 is a timing chart showing events on a time scale.

However, in the case where the preliminary treatment unit 11*i* calculates the forward/backward trajectorys, the events retrieved in the recording order is not appropriate, and the retrieval in the playback mode is described with reference to FIG. 25. In the record frame shown in FIG. 25, a key-on event KON32 takes place at time t44 for a key 10*a* with key code KC1, and another key 10*a* with key code KC2 has a key-on event KON33 at time t45. The preliminary treatment unit 11*i* determines the forward/backward trajectorys FB1 for the key KC1 and the forward/backward trajectorys FB2 for the key KC2. If the key motions are reproduced without time delay, the actuation time t63 of the key KC2 is earlier than the actuation time t64 of the key KC1, and the events are exchanged in the time scale.

For this reason, the event data are rearranged so as to take place in the order to be processed by the preliminary treatment unit 11*i*. In this instance, each event data contains the key code, the time code, the initial key depressing velocity, the acceleration and so on: however, the data rearrangement on the memory consumes large amount of time. The automatic player piano implementing the third embodiment explains event data as a structural body, and the structural body has a pointer variable indicative of the addresses of related events in the structural body. This results in accelerating the rearrangement of the events.

Figure 26A:
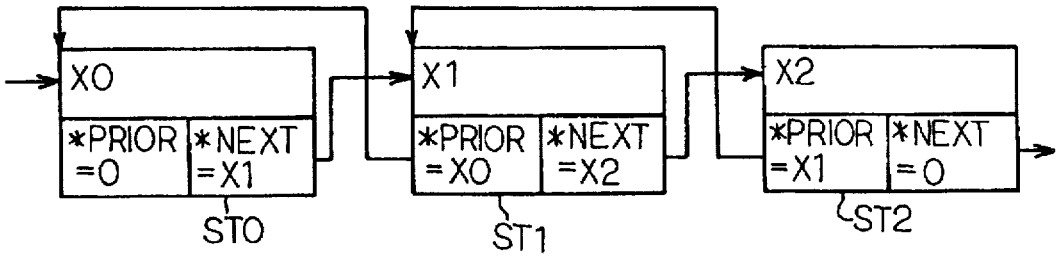
FIGS. 26A to 26C are block diagrams showing a rearrangement of event data.
Figure 26B:
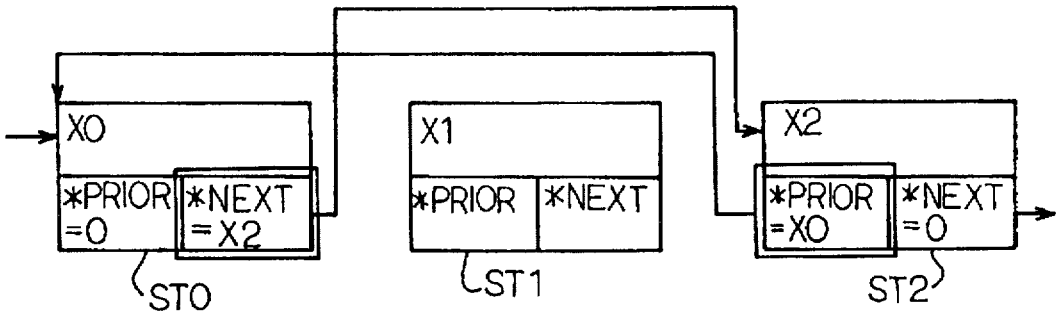

Detailed description on the rearrangement is hereinbelow made with reference to FIGS. 26A to 26C of the drawings. In FIG. 26A, reference ST0 to ST2 designate structural bodies, and x0, x1 and x2 are representing start addresses of the structural bodies in the memory. Each of the structural bodies ST0 to ST2 contains a member representing data related to one of the events and members respectively representing pointers *PRIOR and *NEXT. When the structural bodies ST0, ST1 and ST2 are successively processed, each of the structural bodies ST0 to ST2 stores the start address of the structural body to be subsequently processed at the pointer *NEXT. For example, as shown in FIG. 26A, the start address "x1" is stored in the pointer of the structural body ST0, and the start address "x2" of the next structural body is stored in the pointer *NEXT of the structural body ST1. The structural body ST0 is the first one to be processed, and the pointer *PRIOR thereof stores zero. The pointer *NEXT of the structural body to be finally processed also stores 0".

On the other hand, the pointer *PRIOR of each structural body stores the start address of the structural body to be previously processed.

Thus, the structural bodies ST0 to ST2 are linked with one another by using the pointers *PRIOR and *NEXT, and the pointers *PRIOR and *NEXT allows a data processor to bidirectionally access the event data at high speed, i.e., any one of the ascending order and the descending order.

In order to delete an event, the structural body related to the event is omitted from the linkage. In an example shown in FIG. 26B, the pointer *NEXT of the structural body ST0 is changed to the start address x2, and the pointer *PRIOR of the structural body ST2 is changed to the start address x0. In this way, the structural body ST1 is omitted from the linkage. Even though the structural body ST1 is omitted from the linkage, the contents of the structural body ST1 are left in the memory.

Figure 26C:
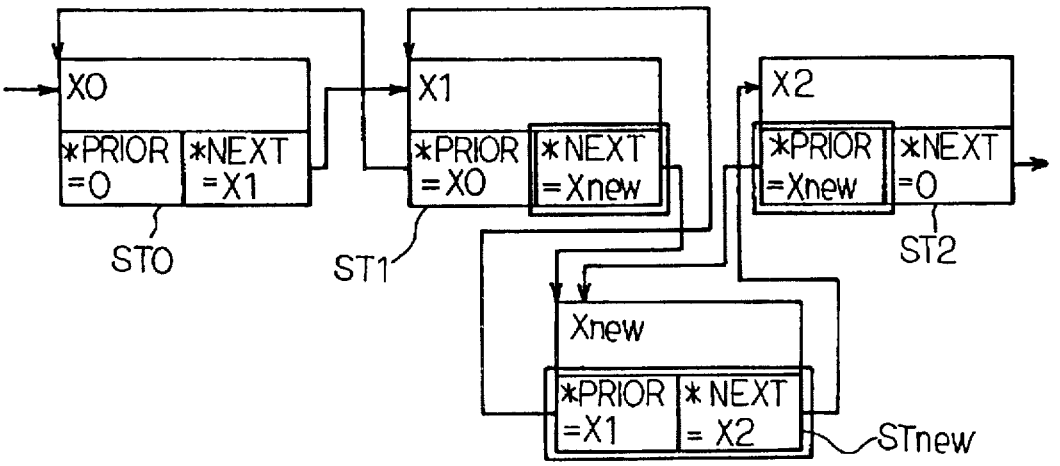

If a new event is inserted into the linkage, the pointers *PRIOR and *NEXT at the insertion are only rewritten as shown in FIG. 26C. In the example shown in FIG. 26C, a new structural body STnew is inserted between the structural body ST1 and the structural body ST2, and the starting address $x_{new}$ of the structural body STnew is written into the pointer *NEXT of the structural body ST1 and the pointer *PRIOR of the structural body ST2. The pointers *PRIOR and *NEXT of the structural body STnew store the start address x1 of the structural body ST1 and the start address x2 of the structural body ST2, respectively. As the result, event data related to the new structural body STnew are processed between the structural bodies ST1 and ST2.

If a structural body already forming a part of a linkage is changed to another position, the structural body is firstly deleted from the linkage, and is, thereafter, inserted at a new position in the linkage.

2: Arrangement of Third Embodiment

Figure 27:
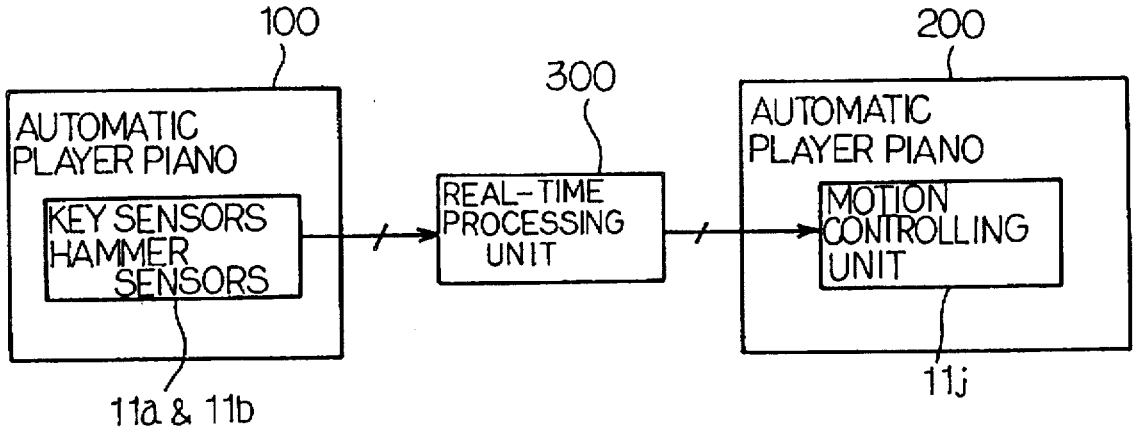
FIG. 27 is a schematic view showing the arrangement of a real time playback system with the automatic player piano according to the present invention.

FIG. 27 illustrates the arrangement of a real time playback system according to the present invention. At least two automatic player pianos 100 and 200 form parts of the real time playback system together with a real-time processing unit 300. The automatic player piano 100 and 200 are similar to the automatic player piano implementing the first or second embodiment, and, for this reason, components of the automatic player piano are labeled with the same references as those of the first and second embodiments without detailed description.

In this instance, the automatic player piano 100 and the automatic player piano 200 serve as a data source and a data sink, respectively, and the real-time processing unit 300 is inserted between the key/hammer sensors 11*a* and 11*b* of the automatic player piano 100 and the motion controlling unit 11*j* of the automatic player piano 200.

Though not shown in the drawings, the real-time processing unit 300 has a central processing unit, a random access memory and a read only memory, and is equivalent to the recording unit 11*s*, the post treatment unit 11*t* and the preliminary treatment unit 22*i* or 21*i*. In other words, the real-time processing unit 300 determines the forward/backward trajectorys on the basis of the key/hammer events detected in the automatic player piano 100, and supplies the preliminary control data signals PCTL1 to the motion controlling unit 11*j* for driving the keys 10*a* of the automatic player piano 200.

Figure 28A:
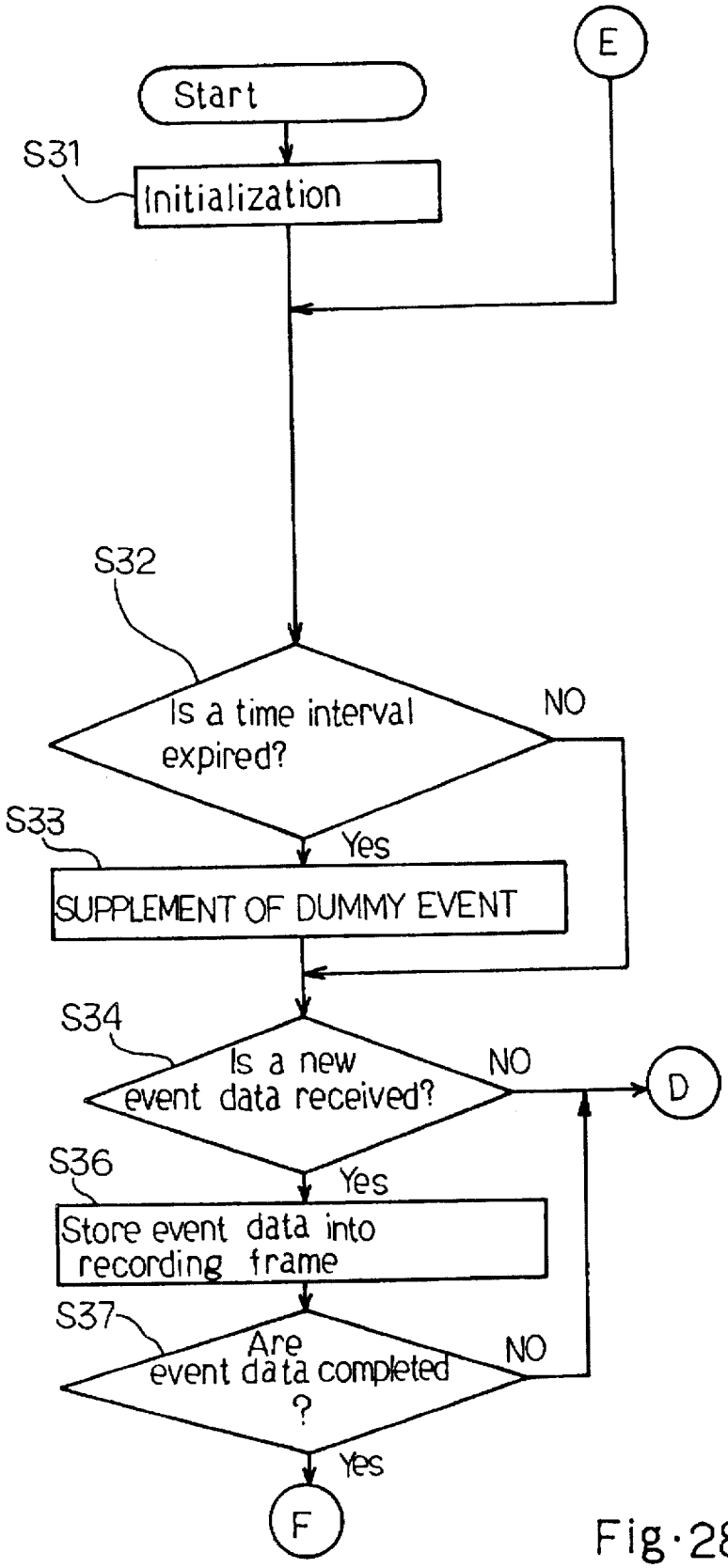
FIGS. 28A and 28B are flow charts showing a program sequence executed by a real-time processing unit incorporated in the real time playback system.
Figure 28B:
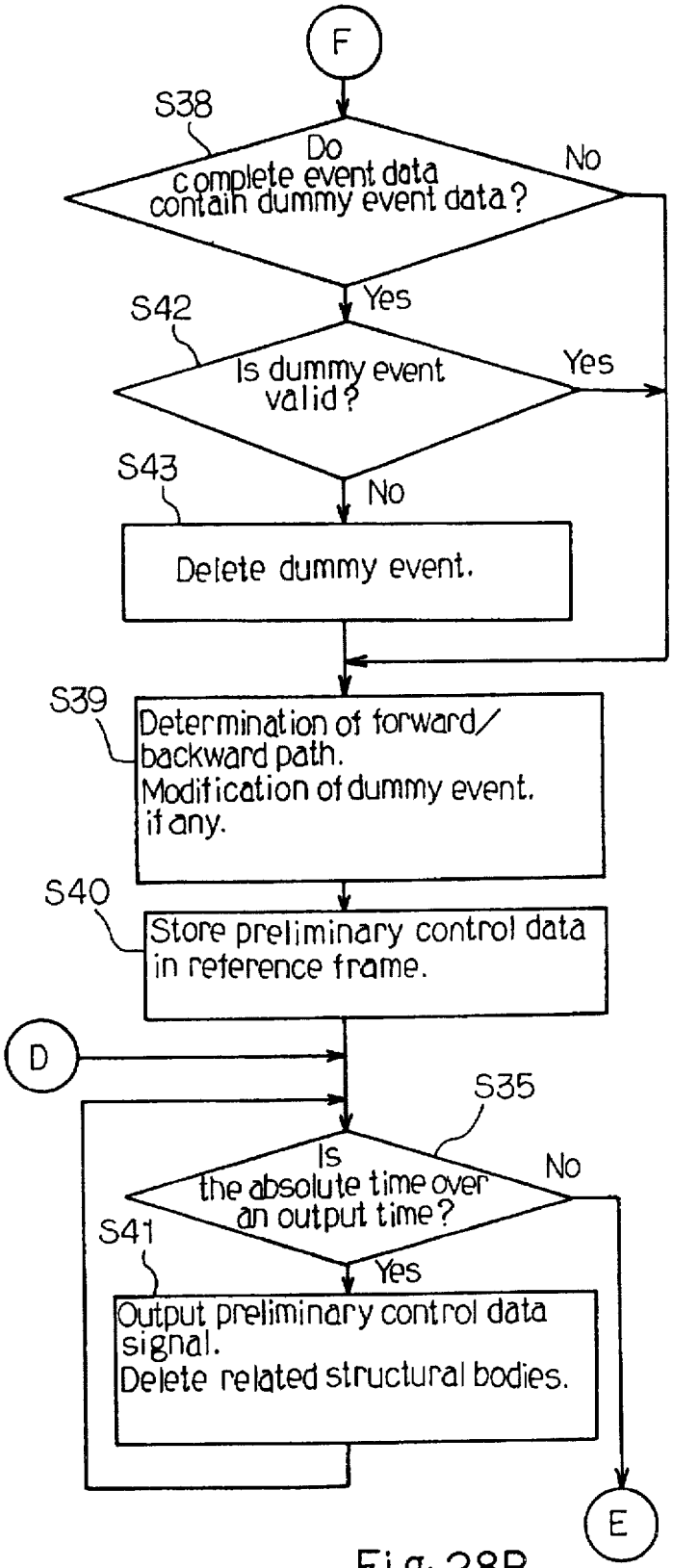

3: Functions of Real-Time Playback System 3-1: Function of Real-Time Processing Unit FIGS. 28A and 28B illustrate a program sequence executed by the real-time processing unit 300. When the real-time processing unit 300 is powered on, the real-time processing unit 300 starts the program sequence, and carries out an initialization thereof as by step S31. In the initialization, zero is provided to a time register.

Figure 29:
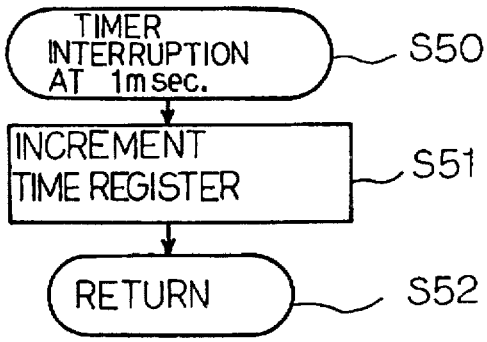
FIG. 29 a flowchart showing a timer interrupt routine executed by the real-time processing unit.

The real-time processing unit 300 counts 1 millisecond, and interrupts the program sequence shown in FIGS. 28A and 28B at intervals of 1 millisecond as by step S50 of FIG. 29. The real-time processing unit 300 increments the time register as by step S51, and returns to the program sequence. Therefore, the time register stores an absolute time interval from the initialization.

After the initialization, the real-time processing unit 300 proceeds to step S32, and checks time monitoring keys to see whether or not one of the time monitoring keys is expired. The time monitoring keys are provided in the internal memory of the real-time processing unit 300 for depressed keys 10*a* of the automatic player piano 100, and variables are written into the time monitoring keys. The time interval is indicative of the longest time interval from the key-on event to the hammer event, and is sequentially decremented by the real-time processing unit 300. Immediately after the initialization, the time monitoring key has not been assigned to a key 10*a* yet, because a player does not start a performance on the keyboard of the automatic player piano. The answer at step S32 is given negative, and the real-time processing unit 300 proceeds to step S34 without execution of step S33.

At step S34, the real-time processing unit 300 checks an input port thereof to see whether or not a new event data is supplied from the automatic player piano 100. Before the player starts a performance, the answer at step S34 is given negative, and the real-time processing unit 300 proceeds to step S35. The real-time processing unit 300 checks the internal memory thereof to see whether or not the absolute time stored in the time register exceeds output times. The output time is indicative of an output timing of the preliminary control data signal for the automatic player piano 200. Since the player has not started an performance, the output times are not written in the internal memory, and the real-time processing unit 300 returns to step S32. Thus, the real-time processing unit 300 reiterates the loop consisting of steps S32, S34 and S35 until the player starts an performance.

When the player starts an performance, event data are sequentially supplied from the automatic player piano to the real-time processing unit 300, and the answer at step S34 is changed to "Yes". Then, the real-time processing unit 300 proceeds to step S36. The first event data is assumed to be the key-on event KON31 for the key KC1 at time t41 (see FIG. 25), and the real-time processing unit 300 forms the structural body for the key-on event KON31. The structural body is hereinbelow labeled with the same reference as the event.

The structural body KON31 has the first member indicative of the key code KC1, the second member indicative of the key-on time equal to the absolute time upon receipt of the key-on event KON31, the third member of the key-on velocity and the fourth and fifth members respectively indicative of the pointers *PRIOR and *NEXT. The pointers *PRIOR and *NEXT of the structural body KON31 store the start address of the structural body KON31. The structural body KON31 is not linked with another structural body, because the structural body KON31 is the first event data supplied to the real-time processing unit 300. However, a structural body received thereafter is linked with the structural bodies previously received and subsequently received by using the pointers *PRIOR and *NEXT, and the event data received by the real-time processing unit 300 are arranged into a recording frame (see FIG. 25).

The real-time processing unit 300 is further operative at step S36 to provide the time monitoring key in the internal memory for the key KC1. The variable stored in the time monitoring key KC1 is equal to the total of the longest time interval between the actuation time and the impact time and the absolute time t41. As a result, the time interval stored in the time monitoring key is compared with the absolute time to see whether or not the time interval is expired at every step S32.

If the time interval stored in the time monitoring key is expired, the answer at step S32 is given affirmative, and the real-time processing unit 300 supplements the dummy key/hammer event into the recording frame.

After the storage of the key-on event KON1 at step S36, the real-time processing unit 300 proceeds to step S37, and checks the recording frame to see whether or not the event data stored in the recording frame are sufficient for the forward or backward trajectory of the key KC1. The event data sufficient for the forward or backward trajectory are hereinbelow referred to as "complete event data". The event data are insufficient for the forward or backward trajectory at time t41, because the hammer event VH31 has not been supplied yet. For this reason, the answer at time t41 is given negative, and the real-time processing unit 300 proceeds to step S35. The answer at step S35 is given negative again, and the real-time processing unit 300 returns to step S32.

The real-time processing unit 300 receives the hammer event VH31 at time t42, and the answer at step 34 is given affirmative again. The real-time processing unit 300 produces a new structural body VH31 for the hammer event, and stores the structural body VH31 in the recording frame at step S36. When the structural body VH31 is stored in the recording frame, the structural bodies KON31 and VH31 allow the real-time processing unit 300 to determine the forward trajectory, and the answer at step S37 is changed to "Yes". Then, the real-time processing unit 300 proceeds to step S38, and checks the recording frame to see whether or not the complete event data contain dummy event data. Both of the key-on event data KON31 and the hammer event data VH31 are real event data, and the answer at step S38 is given negative at time t42.

Then, the real-time processing unit 300 proceeds to step S39, and determines the forward trajectory for the key KC1 on the basis of the key-on event data and the hammer event data. The real-time processing unit 300 produces preliminary control data indicative of the forward trajectory, and stores the preliminary control data in the internal memory in the form of the structural body as by step S40.

Whenever the forward/backward trajectory is determined, the real-time processing unit 300 forms the preliminary control data into the structural body, and the structural bodies are linked with one another in sequence of actuation time by using the pointers *PRIOR and *NEXT. The structural bodies thus linked in the internal memory are hereinbelow referred to as "reference frame" (see FIG. 25).

Although the forward trajectory for the key KC1 has the actuation time t61, the actuation time t61 is past at time t42, and it is impossible to actuate the corresponding key KC1 of the automatic player piano 200 at time t61. In fact, the calculation on the detected event data sometimes results in a time interval between events different from the time interval between the detected time interval, and some events are past. For this reason, the real-time processing unit 300 introduces a time delay td, and retards the actuation time t61 to time t71, and determines the output times t71 to t78. As a result, the automatic player piano 200 reproduces the performance in accordance with the reference frame shown in FIG. 25.

After step S40, the real-time processing unit 300 checks the structural body with the earliest actuation time to see whether or not the output time is over the absolute time as by step S35. The structural body VH31 is stored in the reference frame at time t42, and the actuation of the key KC1 is a future event. For this reason, the answer at step S35 is given negative, and the real-time processing unit 300 returns to step S32. Thus, the real-time processing unit 300 receives event data, and forms the structural bodies from the complete event data in the reference frame.

When the absolute time reaches the output time t31, the answer at step S35 is changed to "Yes", and the real-time processing unit 300 generates the preliminary control data signal indicative of the forward trajectory for the key KC1 on the basis of the structural body stored in the reference frame. The preliminary control data signal is supplied to the motion controlling unit of the automatic player piano 200, and the real-time processing unit 300 deletes the related structural bodies from the record frame and the reference frame. The memory areas occupied by the related structural bodies are released, and new structural bodies are newly stored therein.

If the time interval stored in the time monitoring key is expired, the real-time processing unit 300 supplements a dummy event at step S33 as described hereinbefore. However, real event data corresponding to the dummy event data may reach the real-time processing unit 300 immediately after the supplement of the dummy event data. The real-time processing unit 300 is expected to arbitrate between the real event data and the dummy event data as follows.

When the dummy event data is supplemented, a complete event data is formed, and the real-time processing unit 300 proceeds through steps S36 and S37 to step S38. The real event data corresponding to the dummy event data are stored in the record frame at step S36. At step S38, the answer is given affirmative, and the real-time processing unit 300 checks the record frame to see whether or not the dummy event data are valid as by step S42. If the corresponding real event data are not stored in the record frame, the dummy event data are valid, and the real-time processing unit 300 proceeds to step S39. However, if the corresponding real event data are found in the recording frame, the answer at step S42 is invalid, and the answer at step S42 is given negative. With the negative answer, the real-time processing unit 300 proceeds to step S43, and deletes the dummy event data. As a result, the real event data form the structural body, and the real-time processing unit 300 determines the forward/backward trajectory for the key.

3-2: Playback Function

Subsequently, the behavior of the real time playback system is described hereinbelow. When a player starts a performance on the keyboard of the automatic player piano 100, the key sensors 11*a* and the hammer sensors 11*b* sequentially detect the depressed keys 10*a* and the impacts at the strings 10*e*, and the key position signals KP and the hammer position signals HP are supplied to the real-time processing unit 300.

The real-time processing unit 300 calculates the key-on velocity and the released key velocity, and forms the linkages of the structural bodies in the record frame. The real-time processing unit 300 determines the forward/backward trajectorys for the depressed/released keys 10*a*, and forms a linkage of the structural bodies in the reference frame.

When the absolute time reaches the output time set for one of the structural bodies indicative of the forward trajectory, the real-time processing unit 300 generates the preliminary control data signal PCTL, and supplies the preliminary control data signal PCTL to the motion controlling unit 11*j* of the automatic player piano 200.

The preliminary control data signal PCTL is representative of the trajectory expressed by equation 3, and the motion controlling unit 11*j* generates the control data signal CTL indicative of a series of expected positions of the plunger 11*m* and, accordingly, a series of target position of the key. The control data signal CTL is supplied from the motion controlling unit 11*j* to the servo-controlling unit 11*k*, and the servo-controlling unit 11*k* drives the key through the feedback loop. The key of the automatic player piano 200 sinks toward the end position, and the associated hammer assembly 10*c* strikes the set of strings 10*e* at the same intensity of the corresponding hammer assembly 10*c* of the automatic player piano 100.

When key-off event data is completed, the real-time processing unit 300 also forms the backward trajectory for the released key, and stores the structural body indicative of the backward trajectory in the reference frame. The real-time processing unit 300 supplies the preliminary control data signal PCTL representative of the backward trajectory to the motion controlling unit 11*j* upon expiry of the predetermined output time. The motion controlling unit 11*j* determines the backward trajectory expressed by equation 6 for the released key, and generates the control data signal CTL on the basis of the preliminary control data. The control data signal CTL is supplied to the servo-controlling unit 11*k*, and the servo-controlling unit 11*k* controls the actual position of the plunger 11*m* through the feedback loop. The key of the automatic player piano 200 rises toward the rest position, and the original key motion, i.e., the forward trajectory/backward trajectory are faithfully reproduced by the corresponding key of the automatic player piano 200.

Even if the half stroke keys take place in the original performance, the real-time processing unit determines the composite trajectory, and the automatic player piano faithfully reproduces the half stroke keys.

As will be appreciated from the foregoing description, the real-time processing unit adds the time codes to the key/hammer event data, and retards the key/hammer events for the playback. For this reason, even if the actuation time is past at the determination of the forward trajectory, the real-time processing unit 300 can sequentially supply the preliminary control data signals to the motion controlling unit 11*j* of the automatic player piano serving as the data sink, and the automatic player piano faithfully reproduces the original performance in parallel to the automatic player piano serving as the data source.

The time delay is effective against the different time consumption due to the dummy event data, and the key/hammer events are arranged in regular order in the reference frame.

If the real-time processing unit determines the parabolic forward trajectory and the linear backward trajectory, the calculation of the parabolic forward data consumes rather long time than the calculation of the linear backward trajectory. However, the delay time takes up the difference, and the key/hammer events are arranged in regular order in the reference frame. The difference in the processing time further takes place in a selective normalization for the final hammer velocities. In detail, if the final hammer velocities for low-pitch/high-pitch tones are increased, the processing time for the normalization is different between the low-pitch/high-pitch tones and the middle-pitch tones, and a time difference takes place in the normalization. However, the time delay absorbs the time difference, and the key/hammer events are arranged in regular order.

Modifications

The above described three embodiments may be modified as follows.

1: Servo-Control

Although the above described embodiments carry out a position servo control by means of the motion controlling unit 11*j* and the servo-controlling unit 11*k*, the first embodiment may carry out a velocity servo control. Namely, the motion controlling unit 11*j* provides an initial velocity at the actuation time for a depressed key and the actuation time for a released key, and the servo controller 11*k* maintains the given velocity.

Moreover, the second embodiment may carry out an acceleration servo control. Namely, the motion controlling unit 11*j* supplies an initial velocity and an increment of the velocity with time. The servo controlling unit 11*j* accumulates the initial velocity and the increments with time, and controls the acceleration of the plunger 11*m*.

2: Application of Estimated Acceleration to Electronic Keyboard Musical Instrument The method of estimating the acceleration may be applied to an electronic keyboard musical instrument. Namely, if a key velocity and a hammer velocity are known, the acceleration is estimated for a depressed key, and the estimated acceleration is available for controlling the tone generation in the electronic keyboard musical instrument. An electronic keyboard musical instrument memorizes a plurality of tone waveforms, and the tone waveforms are selected by using the tone intensity and/or a pitch. If the electronic keyboard musical instrument estimates the acceleration, the tone waveforms are selected by using the estimated tone waveform.

3: Available Attributes of Motion

The first embodiment controls the key velocity at the reference point Xr, and the second embodiment controls the key acceleration at the reference point Xr. Another attribute of the key motion is available in so far as the attribute reproducibly describes the motion. Such available attributes are one of the velocity, the acceleration and the force and a combination thereof.

4: Parabolic Backward Path

Although the above described embodiments assume the backward key motion to be uniform tracing a linear backward trajectory, another modification may assume the backward key motion to be a uniformly accelerated motion. In order to determines a parabolic backward trajectory, each of the key sensors 11*a* requires more than two photo-couplers, and the recording unit or the real-time processing unit calculates two released key velocities. Any combination of the parabolic trajectory and the linear trajectory is available for the forward/backward key motions.

5: Available Calculation

Equations 18, 19 and 20 contain an extraction of square root. If the extraction of square root is a problem for a data processor, a binary search may be available.

6: Reproduction of Soft Impact

In actual recording, when a player softly depresses a key, the key tends to move along a parabolic forward trajectory, and it is impossible to reproduce a pianissimo (pppp) through a linear forward trajectory. For this reason, a modification may estimates the forward trajectory for a soft key touch to be a parabola and the other forward trajectorys to be linear.

7: Available Data

Japanese Patent Publication of Unexamined Application No. 1-239594 discloses a keyboard musical instrument which estimates a hammer velocity on the basis of a key velocity of a depressed key. If such a velocity data is stored instead of the hammer velocity data, the above described embodiments may use the other velocity data. A piece of key-on or key velocity information of a MIDI (Musical Instruments Digital Interface) code is therefore available, and a time data for generating a sound or an intensity data for the sound are also available for the embodiments.

8: Available Frame

In the third embodiment, the structural bodies are linked by using the pointers in the record frame and the reference frame. The means for the linkage is not limited to the pointers. FAT (File Allocation Table) may be available as similar to a magnetic disk recording. Namely, the addresses are arranged in the sequence of time code, and data are accessed after reference to the address table.

9: Supplement of Dummy Event

Steps S9 and S15 may be deleted from the program sequence shown in FIGS. 9A and 9B, and the post treatment unit directly proceeds to steps S12 and S10 with the positive answers at step S6 and S14.

Although the dummy key/hammer events are supplemented before the output to the external memory system, the external memory system may memorize detected or real events only, and dummy key/hammer events may be supplemented after read-out of the real events in the playback mode.

When the time interval is expired at step S32, the real-time processing unit 300 supplements a dummy event data. However, a modification of the real-time processing unit may supplement a dummy event if a key-on event, a hammer event and a key-off event are not orderly arranged as similar to the first embodiment.

In the first embodiment, the dummy events are supplemented at the same time as the real events through steps S12 and S10, and the supplemented dummy events are modified at step S13 and S11. The supplement at the same time as real events indicates that the supplemented events are unusual, and no discriminative code is necessary for the dummy events. However, dummy events may be supplemented at appropriate timings so as to delete steps S13 and S11.

10: Built-in Real-Time Processing Unit

Although the real time playback system has the real-time processing unit 300 outside of the automatic player pianos 100 and 200, the real-time processing unit 300 may be incorporated in one of the automatic player pianos 100 and 200 so as to supplement the dummy events and calculate the forward/backward trajectorys.

11: Possible Usage of Event Supplement Technology

The event supplement technology is used for determination of the forward/backward trajectorys in the above described embodiments. The event supplement technology is applicable to the system disclosed in Japanese Patent Publication of Unexamined Application No. 1-239594 where the system carries out various tasks by using event data.

Although the dummy key-off event data decides the released key velocity to be the maximum value as indicated by BP1 of FIG. 6, the released key may trace a linear backward trajectory BP1'. Thus, the contents of the dummy key/hammer event data are not limited to the values described in conjunction with the embodiments.

As will be understood from the foregoing description, the keyboard musical instrument having the event repairing means decreases the number of key sensors and the number of hammer sensors, because missing events are supplemented.

Although particular embodiments of the present invention have been shown and described, it will be obvious to those skilled in the art that various changes and modifications may be made without departing from the spirit and scope of the present invention. For example, the present invention is applicable to a modification of the keyboard musical instrument disclosed in U.S. Ser. No. 08/073,092 which is equipped with an automatic playing system.

What is claimed is:

1. A keyboard musical instrument comprising:

an event detecting means for detecting a key depressing event and a strike event;

a memory means for storing said key depressing event and said strike event;

an event repairing means operative to read out contents of said memory means and supplement missing event if said key depressing event or said strike event is missed, thereby producing a music data; and a key driving means operative to determine a target trajectory for a key, and driving said key along said target trajectory.

2. The keyboard musical instrument as set forth in claim 1, in which said dummy event data supplying means decides to supplement said dummy event data when said hammer event data is missed between said key-on event data and said key-off event data.

3. The keyboard musical instrument as set forth in claim 1, in which said dummy event data supplying means decides to supplement said dummy event data when said hammer event data is not supplied to said event data producing means within a predetermined time interval after the receipt of said key-on event data.

4. A keyboard musical instrument having at least a recording mode and a playback mode, comprising:

an acoustic piano having a plurality of keys selectively moved between respective rest positions and respective end positions by a player in said recording mode, a plurality of key action mechanisms functionally connected to said plurality of keys, respectively, and selectively actuated by said plurality of keys in both of said recording mode and said playback mode, a plurality of hammer assemblies functionally connected to said plurality of key action mechanisms, and selectively driven for rotation by said plurality of key action mechanisms in both of said recording mode and said playback mode, and a plurality of string means respectively associated with said plurality of hammer assemblies, and selectively struck by said plurality of hammer assemblies; and an automatic playing system having a plurality of key sensors operative to respectively monitor said plurality of keys in said recording mode for producing key position signals each indicative of an actual key position of the monitored key, a plurality of hammer sensors operative to respectively monitor said plurality of hammer assemblies in said recording mode for producing hammer position signals each indicative of an actual hammer position of the monitored hammer assembly, an event data producing means connected to said plurality of key sensors and said plurality of hammer sensors, and operative to produce a key-on event data indicative of a first motion of each key moved toward said end position on the basis of said key position signal, a key-off event data indicative of a second motion of each key moved toward said rest position on the basis of said key position signal and a hammer event data indicative of a strike of each hammer assembly at one of said plurality of string means on the basis of said hammer position signal in said recording mode, a dummy event data supplying means operative to supplement a dummy event data when said key-on event data, said hammer event data and said key-off event data are supplied to said event data producing means in irregular order, a music data producing means operative to produce a plurality of music data indicative of a performance in said recording mode on the basis of not only the key-on event data, the hammer event data and the key-off event data but also the dummy event data, if any, a plurality of actuator units respectively provided for said plurality of keys, and respectively responsive to a plurality of driving signals for selectively moving said plurality of keys in said playback mode, and a controlling means responsive to said plurality of music data in said playback mode for producing said plurality of driving signals.

5. A real time playback system for reproducing a music while a player is performing said music, comprising:

a master acoustic piano having a plurality of first keys selectively depressed by said player, and moved between respective rest positions and respective end positions, a plurality of first key action mechanisms functionally connected to said plurality of first keys, respectively, a plurality of first hammer assemblies selectively driven for rotation by said plurality of first key action mechanisms when said plurality of first keys are selectively depressed, a plurality of first string means selectively struck by said plurality of first hammer assemblies selectively driven by said plurality of first key action mechanisms for producing first acoustic sounds, a plurality of key sensors respectively monitoring said plurality of first keys for producing key position signals each indicative of a series of actual key positions of an associated one of said plurality of first keys, and a plurality of hammer sensors respectively monitoring said plurality of hammer assemblies for producing hammer position signals each indicative of a series of actual hammer positions of an associated one of said plurality of first hammer assemblies;

a slave acoustic piano having a plurality of second keys corresponding to said plurality of first keys, a plurality of actuator units respectively provided for said plurality of second keys, and responsive to a plurality of driving signals for selectively moving said plurality of second keys, a plurality of second key action mechanisms functionally connected to said plurality of second keys, respectively, a plurality of second hammer assemblies selectively driven for rotation by said plurality of second key action mechanisms when said plurality of second keys are selectively moved by said plurality of actuator units, and a plurality of second string means selectively struck by said plurality of second hammer assemblies driven by said plurality of second key action mechanisms for producing second acoustic sounds; and a real-time processing unit having an event data producing means connected to said plurality of key sensors and said plurality of hammer sensors, and operative to produce a key-on event data indicative of a first motion of each first key moved toward said end position on the basis of said key position signal, a key-off event data indicative of a second motion of each first key moved toward said rest position on the basis of said key position signal and a hammer event data indicative of a strike of each first hammer assembly at an associated one of said plurality of first string means on the basis of said hammer position signal, a dummy event data supplying means operative to supplement a dummy event data when said key-on event data, said hammer event data and said key-off event data are supplied to said event data producing means in irregular order, a music data producing means operative to produce a plurality of music data indicative of a performance of said music on said plurality of first keys on the basis of not only the key-on event data, the hammer event data and the key-off event data but also the dummy event data, if any, a controlling means responsive to said plurality of music data for producing said plurality of driving signals, and a delay means operative to introduce a time delay between a production of each of said plurality of music data and a production of each of said plurality of driving signals.

6. The real time playback system as set forth in claim 5, in which said real-time processing unit is incorporated in one of said master acoustic piano and said slave acoustic piano.

* * * * *